US006947679B2

(12) United States Patent
Kato et al.

(10) Patent No.: US 6,947,679 B2
(45) Date of Patent: Sep. 20, 2005

(54) IMAGE FORMING APPARATUS AND FIXING TEMPERATURE CONTROL METHOD

(75) Inventors: Akira Kato, Shizuoka (JP); Takeshi Sugita, Shizuoka (JP); Atsushi Wada, Shizuoka (JP); Tatsubumi Mizuno, Shizuoka (JP); Satoshi Nishida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/649,763

(22) Filed: Aug. 28, 2003

(65) Prior Publication Data

US 2004/0047641 A1 Mar. 11, 2004

(30) Foreign Application Priority Data

Aug. 29, 2002 (JP) ..... 2002-251991

(51) Int. Cl.[7] ..... G03G 15/16; G03G 15/20
(52) U.S. Cl. ..... 399/45; 399/66; 399/69
(58) Field of Search ..... 399/66, 69, 67, 399/310, 314, 45

(56) References Cited

U.S. PATENT DOCUMENTS

| | | | | | |
|---|---|---|---|---|---|
| 5,099,287 | A | * | 3/1992 | Sato | 399/45 |
| 5,138,392 | A | * | 8/1992 | Kinoshita et al. | 399/45 |
| 5,404,214 | A | | 4/1995 | Yoshimoto et al. | |
| 5,493,379 | A | | 2/1996 | Kuroda et al. | |
| 5,525,775 | A | | 6/1996 | Setoriyama et al. | 219/216 |
| 5,532,806 | A | | 7/1996 | Sugita et al. | |
| 5,621,451 | A | | 4/1997 | Sugiura et al. | 347/112 |
| 5,717,981 | A | * | 2/1998 | Yamanaka | 399/45 |
| 5,724,630 | A | * | 3/1998 | Mashiba | 399/69 |
| 5,752,149 | A | | 5/1998 | Yuza et al. | 399/329 |
| 5,887,220 | A | * | 3/1999 | Nagaoka | 399/66 |
| 5,953,556 | A | * | 9/1999 | Yamanaka | 399/66 |
| 6,094,559 | A | | 7/2000 | Otsuka et al. | 399/327 |
| 6,175,699 | B1 | | 1/2001 | Kato et al. | 399/69 |
| 6,177,977 | B1 | | 1/2001 | Tanaka et al. | |
| 6,185,381 | B1 | | 2/2001 | Nakahara et al. | 399/21 |
| 2003/0016958 | A1 | | 1/2003 | Wada et al. | 399/45 |
| 2003/0077092 | A1 | | 4/2003 | Ogawa et al. | 399/328 |

FOREIGN PATENT DOCUMENTS

| | | | | |
|---|---|---|---|---|
| JP | 4-44075 | | 2/1992 | |
| JP | 2001-290316 | | 10/2001 | |
| JP | 2003005576 | A * | 1/2003 | G03G/15/20 |

* cited by examiner

*Primary Examiner*—Susan Lee
(74) *Attorney, Agent, or Firm*—Fitzpatrick, Cella, Harper & Scinto

(57) ABSTRACT

An image forming apparatus has sufficient fixing stability and load capacity and being free of sheet jamming and poor image formation. An image forming apparatus includes a transfer voltage applying section for applying a voltage to a transfer section; a transfer current detector for detecting the transfer current flowing through the transfer section; a fixing section for fixing the toner image to fixing position at a predetermined temperature; and a size detector for detecting the size of the recording material. The transfer voltage applying section applies a predetermined transfer voltage, while the recording material passes through the transfer section, so that the transfer current is kept a constant current. When the predetermined transfer voltage is lower than a threshold voltage and the size of the recording material is larger than the predetermined size, the fixing section fixes the toner image at a temperature which is lower than the predetermined temperature.

25 Claims, 18 Drawing Sheets

H/H ENVIRONMENT, RECORDING MATERIAL P1

| FIXING TEMPERATURE CONTROL | | ORDINARY | -5deg | -10deg | -15deg | -20deg | -25deg |
|---|---|---|---|---|---|---|---|
| DEGREE OF CURLING (mm) | SHEET TYPE 1 | 21 | 14 | 8 | 4 | 1 | 1 |
| | SHEET TYPE 2 | 52 | 35 | 29 | 23 | 15 | 9 |
| NUMBER OF FALLEN SHEETS (ORDINAL NUMBER), * SHEET TYPE 2 | | 8 | 19 | 35 | 71 | 95 | 100 SHEETS/ NO DROP |

FIG.8A

H/H ENVIRONMENT, RECORDING MATERIAL P1

| FIXING TEMPERATURE CONTROL | | -10deg | -15deg | -20deg | -25deg | -30deg | -35deg |
|---|---|---|---|---|---|---|---|
| TEMPERATURE DROP RATIO (%) | SHEET TYPE 1 | 2 | 3 | 4 | 5 | 8 | 12 |
| | SHEET TYPE 3 | 5 | 5 | 7 | 9 | 12 | 17 |
| FIXING STABILITY | | OK | OK | OK | OK | NG | NG |

FIG.8B

H/H ENVIRONMENT, RECORDING MATERIAL P3

| FIXING TEMPERATURE CONTROL | | -10deg | -15deg | -20deg | -25deg | -30deg | -35deg |
|---|---|---|---|---|---|---|---|
| TEMPERATURE DROP RATIO (%) | SHEET TYPE 1 | 3 | 7 | 9 | 11 | 14 | 17 |
| | SHEET TYPE 3 | 7 | 10 | 12 | 13 | 16 | 21 |
| FIXING STABILITY | | OK | NG | NG | NG | NG | NG |

FIG.8C

IMAGE FORMING APPARATUS AND FIXING TEMPERATURE CONTROL METHOD

This application claims priority from Japanese Patent Application No. 2002-251991 filed Aug. 29, 2002, which is incorporated hereinto by reference.

BACKGROUND OF THE INVENTION

1. Field of the Invention

The present invention relates to an image forming apparatus and a fixing temperature control method.

2. Description of the Related Art

Conventionally, the rolling transfer method has been used for the image forming apparatus such as the electrophotographic printer and the electro-photographic copying machine. The rolling transfer method is designed to transfer the toner image formed on an image carrier, such as the photosensitive drum or the like, onto a sheet-like recording material such as a sheet of paper or the like. In the rolling transfer method, a conductive and elastic transfer roller is pressed against the image carrier with a total pressure of about 5–20N thereby to form a transfer nipper section between the image carrier and the transfer roller. The transfer nipper section is designed to nip and transfer the recording material to have the toner image formed on the image carrier transferred onto the recording material by the effect of the transfer voltage (transfer bias) applied to the transfer roller.

Besides, the heat roller method, the film heating method or the like are in use as the method for fixing the toner image (unfixed image), which has been transferred onto the recording material previously, by the effect of the heat. The heat roller system comprises a heating roller (image fixing roller), whose temperature is maintained at a predetermined level, and a pressure roller, which is provided with an elastic layer and pressed against the heating roller to form a fixing nipper section. When the recording material to be transferred is introduced between the rollers constituting the fixing nipper section, the toner image can be fixed on the recording material owing to the heat of the heating roller.

The film heating method is characterized by a system comprising a heater, a film (hereinafter referred to as "a fixing film"), which slides against the heater, and a pressure applying member, which forms, through the sliding film, the fixing nipper section in combination with the heater (Refer, for example, to Japanese Patent Application Laid-open No.4-44075(1992)). The recording material carrying the toner image is introduced into the fixing nipper section, whereby the toner image is thermally fixed on the recording material owing to the heat from the heater. For the heater, one having a low heat capacity and a high heat conductivity, such as a ceramic heater, is used. For the fixing film, a thin film having a low heat capacity is used. In this way, the film heating method reduces a time for setting temperature which the toner image is fixed on the recording material and provides saving of energy.

In the case of the image fixing unit using the film heating method, when the recording material having a high hygroscopic property is introduced and heated at a high temperature, the moisture contained in the recording material evaporates. The evaporation of the moisture in a large quantity gives rise to a problem such as the occurrence of slipping between the recording material and the fixing film or between the recording material and the pressure member. Further, the pressure and the high temperature required for fixing the image can cause the increase in the degree of the curling of the recording material. Increase in the degree of curling results in the decrease in the quantity of the recording material loadable on the ejected sheet tray, thereby giving rise to a problem such as the falling of the overloaded recording material.

In this connection, there is known a method designed so that the set temperature of the image fixing unit can be lowered from the initial setting when the value of the current based on the voltage applied to the transfer roller for the fixing of the image is found to be higher than the predetermined value (Refer, for example, to the Japanese Patent Application Laid-open No. 2001-290316). In general, there is an inverse relationship between the level of the hygroscopic property and the level of the surface resistance of the recording material. The rise of the moisture level in the recording material while the transfer voltage is applied to the recording material results in the increase in the value of current flowing in the transfer roller, and so it is reasonable to lower the set temperature of the image fixing unit when the recording material having a high hygroscopic property is to be processed. In this way, the occurrence of the problem as is discussed above can be prevented by controlling the generation of the water vapor resulting from the rapid rise of the temperature.

On the other hand, however, as long as the set temperature of the image fixing unit is uniformly controlled according to the hygroscopic property of the recording material, it is not always possible to set the temperature to an optimum level depending on the property of the recording material on which the toner image is to be transferred.

For instance, some of the small-size recording materials such as the postcards and envelopes have larger thickness and larger heat capacity than those of the ordinary paper sheets. Fixing the image on a small-size printing material requires a larger quantity of heat than that required for the ordinary sheet of paper. However, in the cases of the conventional arts, there is the possibility that the fixing temperature is set to the level lower than the necessary level even for the small-size recording material shaving a relatively high hygroscopic properties, thereby ending with insufficient fixing stability.

Further, (in the cases of the conventional arts,) there is the possibility that the slippery condition occurs between the recording material and the fixing film or between the recording material and the pressure member owing to evaporation of the moisture contained in the recording material from the non-image area of the fixing nipper section, especially when the print rate of the toner image transferred onto the recording material is relatively high. Further, even in the case of the recording material having a relatively high hygroscopic property, when the print rate of the toner image on the recording material is relatively high, the relatively large quantity of the toner on the recording material and the resulting high surface resistance causes the value of the current flowing in the transfer roller to become relatively small. That is, in the case of the above-mentioned prior art, the resistance of the recording material is determined to be high, so that the set temperature of the image fixing unit remains at a high level. This causes the evaporation of the moisture contained in the recording material and the resulting slippery condition that causes insufficient transfer of the recording material and the problems such as poor reproduction of the image or the jamming of the paper sheets.

SUMMARY OF THE INVENTION

The object of the present invention is to provide an image forming apparatus, having a sufficient fixing stability and a sufficient load capacity for the recording material, and a fixing temperature control method.

An image forming apparatus according to an embodiment of the present invention comprises a transfer section for transferring the toner image formed on an image carrier onto a recording material; a transfer voltage applying section for applying a voltage to the transfer section; a transfer current detector for detecting the transfer current flowing through the transfer section; a fixing section for fixing the toner image transferred onto the recording material by the transfer section to fixing position at a predetermined temperature; and a size detector for detecting the size of the recording material. The transfer voltage applying section applies a predetermined transfer voltage, while the recording material passes through the transfer section, so that the transfer current detected by the transfer current detector is kept a predetermined constant current. When the predetermined transfer voltage is lower than a threshold voltage and the size of the recording material is larger than the predetermined size, the fixing section fixes the toner image at a temperature which is lower than the predetermined temperature.

The transfer voltage applying section may apply the predetermined transfer voltage to the transfer section before the front end of the recording material has passed the fixing position.

The transfer voltage applying section may apply a constant transfer voltage to the transfer section after the recording material has passed the transfer section until the lapse of a predetermined time.

The transfer voltage applying section may apply a first transfer voltage before the recording material passes through the transfer section so that the transfer current detected by the transfer current detector is kept a first constant current; the transfer voltage applying section may apply a second transfer voltage, while the recording material passes through the transfer section, so that the transfer current detected by the transfer current detector is kept a second constant current. When the first transfer voltage is lower than a first threshold voltage, the second transfer voltage is lower than a second threshold voltage and the size of the recording material is larger than the predetermined size, the fixing section fixes the toner image at a temperature which is lower than the predetermined temperature.

In another embodiment of the present invention, the image forming apparatus further comprises a memory for storing a temperature which the fixing section fixes the toner image upon completion of the image formation; and a lapse of time detector for detecting the lapse of the time from the completion of the image formation. If the lapse time detected by the lapse of time detector is lower than a predetermined time upon starting the image formation, the fixing section may fix the toner image at a temperature which is stored in the memory.

When the predetermined transfer voltage is lower than a threshold voltage and the size of the recording material is larger than the predetermined size, the fixing section may fix the toner image for a recording material conveyed following the recording material which the size is detected by the size detector at a temperature which is lower than the predetermined temperature.

Also, the size detector may detect the size of the recording material by detecting the front end and the rear end of the recording material.

Further, the size detector may detect the width of the recording material orthogonal to the direction of the transfer thereof.

The above and other objects, effects, features and advantages of the present invention will become more apparent from the following description of embodiments thereof taken in conjunction with the accompanying drawings.

BRIEF DESCRIPTION OF THE DRAWINGS

FIGS. 8A–8C are the tables showing the load capacity and the fixing stability of the recording material depending on the condition of the recording material and the fixing temperature therefore;

DETAILED DESCRIPTION OF PREFERRED EMBODIMENTS

The embodiments of the present invention will be described referring with accompanying drawings.

(The First Embodiment)

Figure 1:
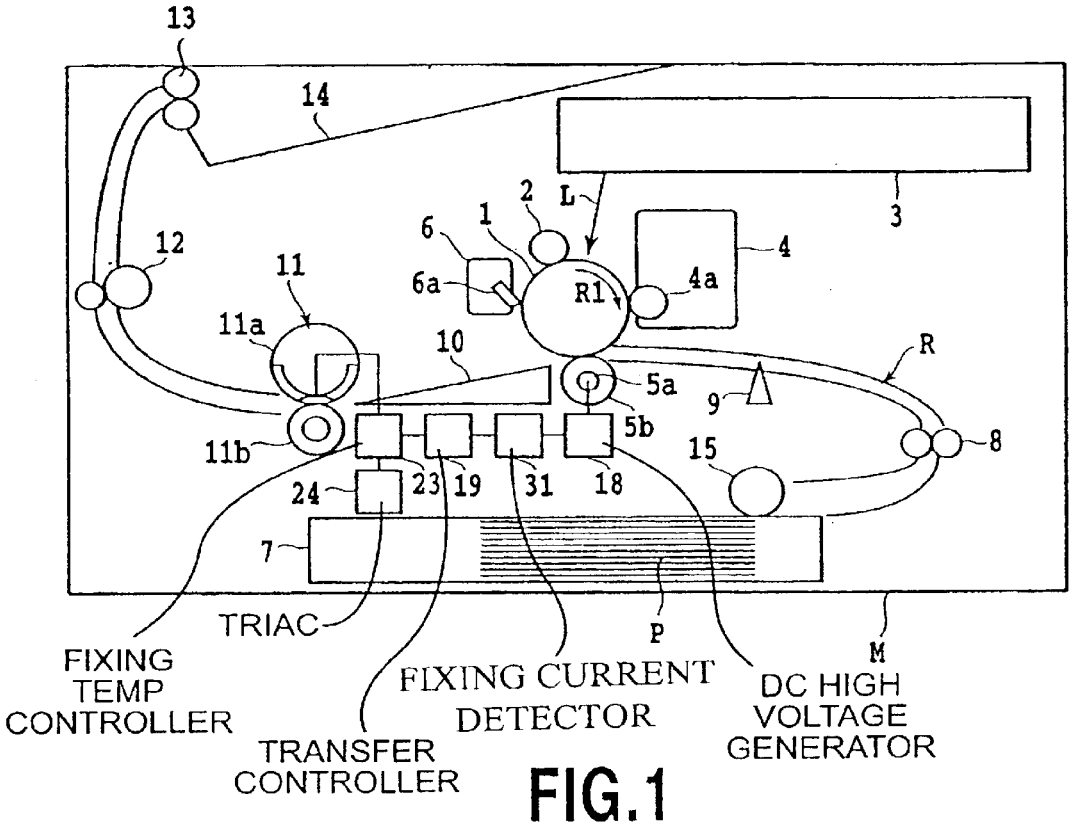
FIG. 1 is a composition diagram of a laser beam printer as an example of the image forming apparatus according to the present invention.

FIG. 1 is a diagram schematically showing the composition of the laser beam printer as an example of the image forming apparatus relating to the present invention. An electro-photographic drum 1 (hereinafter referred to as "photosensitive drum 1") to serve as an image carrier is pivotally supported by the body M (of the image forming apparatus). Further, the photosensitive drum 1 is driven to revolve in the direction indicated by an arrow R1 by a drive means such as a motor (not shown) at a predetermined processing speed. Arranged around and sequentially in the direction of the revolution of the photosensitive drum 1 are a charged roller (charged unit) 2, an exposing unit 3, a developer 4, a transfer roller (an image transfer unit) 5 and a cleaning unit 6.

A feed paper cassette 7, containing the sheet-form recording material such as the paper sheets, is disposed on the bottom of the image forming apparatus. Reference mark R indicates the transfer route of the recording material P. Arranged along the transfer route R in the order starting from the upstream side thereof are a feed sheet roller 15, a transfer roller 8, a top sensor 9, a transfer metal plate 10, a transfer roller 12 and a feed sheet ejector 13. Further, there is provided the transfer roller 5 between the top sensor 9 and the transfer metal plate 10, while there is provided an image fixing unit 11 between the transfer metal plate 10 and the transfer roller 12.

A DC high voltage generator 18 generates the transfer voltage to be applied to the transfer roller 5. A transfer voltage controller 19 controls the DC high voltage generator 18. A fixing temperature controller 23 controls a TRIAC 24 according to an inputted target temperature and the temperature of the thermistor (a temperature sensing element 21) to control the current to a heater 20 thereby to control the temperature of the fixing nipper section N. The transfer voltage controller 19 is capable of setting a target temperature to the fixing temperature controller 23.

The fixing current detector 31 detects a transfer current flowing through the transfer roller 5 when the transfer voltage controller 19 controls the DC high voltage generator 18 to apply the transfer voltage onto the transfer roller 5, and outputs a signal according to a value of the detected transfer current to the transfer voltage controller 19.

Further, the transfer roller 5, designed for having a predetermined transfer bias applied thereto for effecting the transfer of the toner image onto the recording material P, is made up of a core metal, such as Fe, SUS or the like, and an elastic layer 5*b* of a conductive rubber or a conductive sponge or the like provided on the core metal. The elastic layer 5*b* of the transfer roller 5 is designed to have a resistance within the range of $10^6$–$10^{10}\Omega$ by adjusting the content of the conductive filler such as the carbon. Hence, the elastic layer 5*b* has an electronic conductivity, and the resistance thereof tends to decrease, since the concentration of the electric field is subject to occur among the conductive fillers distributed in the elastic layer 5*b* as the voltage applied thereon increases.

The contents of the conductive fillers, such as the carbon, etc., in the elastic layer 5*b* is made adjustable so that the resistance of the elastic layer 5*b* can be varied as much as necessary depending on the environmental condition. For instance, the characteristic of the elastic layer 5*b* can be set for obtaining the resistance within the range of $2.5\times10^7\Omega$–$8\times10^7\Omega$ in high humidity/high temperature (H/H) environment (38° C./80%), the resistance within the range of $1\times10^8\Omega$–$3\times10^8\Omega$ in normal humidity/normal temperature (N/N) environment (23° C./60%) and the resistance within the range of $4\times10^8$–$1.2\times10^8\Omega$ in low humidity/low temperature (L/L) environment (15° C./10%). However, even when the setting for the transfer roller 5 is made in the fashion as is described above, the resistance in each of the above environmental conditions cannot always contained within the above-mentioned range.

The recording material for use in the printer is available in a variety of kinds. For instance, a variety of recording materials whose volume resistance range widely, e.g., within $10^8\Omega$.cm–$10^{17}\Omega$.cm or the like are in use. Since the recording material is highly apt to be influenced by the moisture in the air, the resistance of the recording material varies largely depending on the environmental condition. More specifically, the resistance varies by the scale of 5 figures or more when the environmental condition varies from a low temperature/low humidity environment, where the temperature is 15° C., and the humidity is 10%, to a high temperature/high humidity environment where the temperature is 33° C., and the humidity is 80%.

Figure 2:
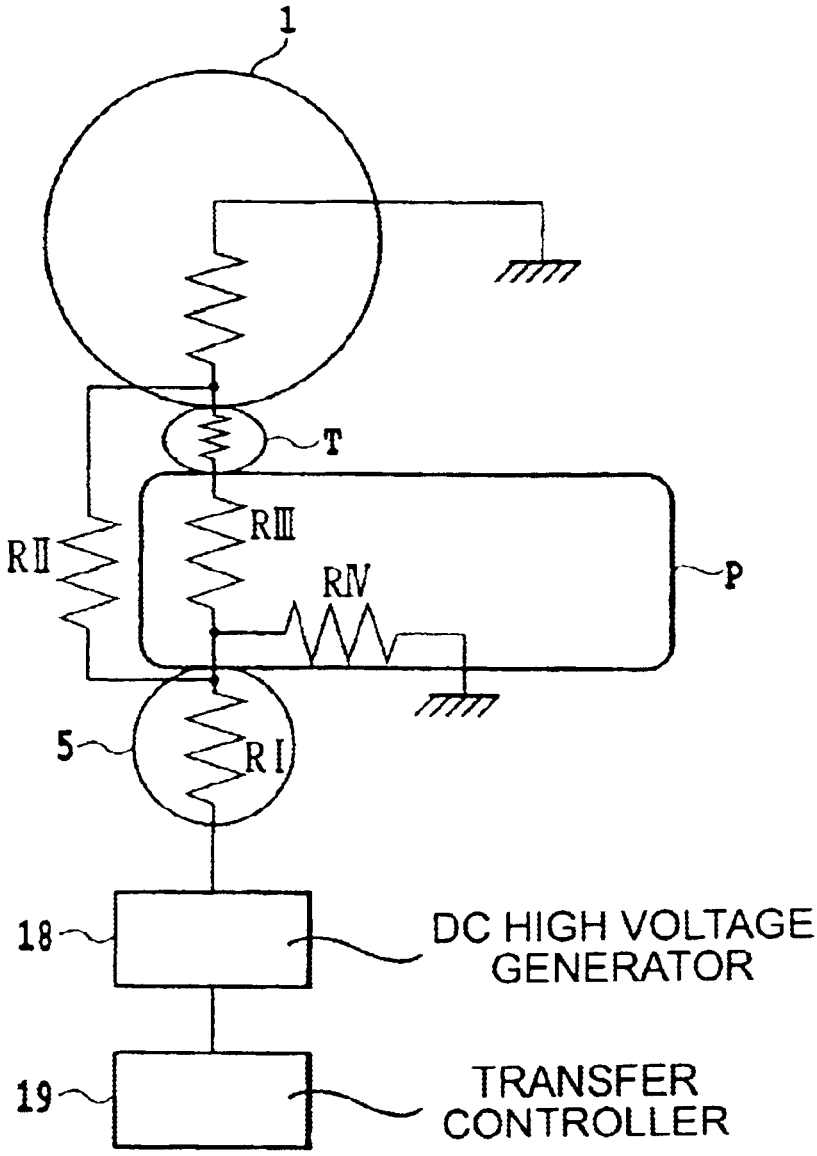
FIG. 2 is a composition diagram showing the equivalent circuits for the recording material, the photosensitive drum, the transfer roller to operate during the sheet passing operation.

Next, the basic control operations of the transfer voltage controller 19 will be described. FIG. 2 shows the operations of the equivalent circuits for the recording material P, the photosensitive drum 1 and the transfer roller 5. The revolution of the photosensitive drum 1 and the revolution of the transfer roller 5 cause the transfer of the recording material P. The transfer roller 5 applies a transfer bias for effecting the transfer of the toner T on the photosensitive drum 1 onto the recording material P. The transfer bias to be applied to the transfer roller 5 is obtained by controlling the transfer voltage from the DC high-voltage generator 18 by the transfer voltage controller 19. A constant current control method is employed as a transfer bias control method so that the toner image can properly be transferred onto the recording material.

The constant current control method is designed so that the current flowing through the recording material P is kept constant during the image transfer process. First, the value of the current detected by the fixing current detector 31 is inputted to the transfer voltage controller 19. Then, the transfer voltage controller 19 adjusts the voltage value to be applied to the transfer roller 5 by the DC high-voltage generator 18 on the basis of the difference between the target current value and the detected current value. In general, the efficiency of image transfer onto the recording material P is dependent on the value of the current flowing through the recording material P. Hence, the image of stable quality can be formed by keeping the value of the current constant without being influenced by the resistance value of the recording material or the like.

For reference, when the recording material P comes into contact with the transfer nipper section, the contact resistance (RII) of the photosensitive drum 1 and the transfer roller 5 increases sharply. In this situation, if the constant current control with low responses is applied, causes an abrupt drop of the current to be applied to the transfer roller 5 and the resulting poor image transfer owing to insufficiency of the transfer current.

For this reason, the constant voltage control is applied as a transfer bias control method before and after the recording material with high contact resistance (RII) comes into contact with the transfer nipper section. For the constant voltage control method, as in the case of Japanese Patent Application Laid-open No. 2-123385(1990), the ATVC (Active Transfer Voltage Control) method, which is designed to properly control the transfer voltage on the basis of estimated resistance of the transfer roller, is employed.

The ATVC method controls a voltage generated by the DC high-voltage generator 18 to flow a predetermined constant current from the transfer roller 5 to the photosensitive drum 1 for charging a surface of the photosensitive drum 1 with a predetermined voltage during the preceding revolution of the transfer roller 5. The ATVC method is designed to estimate the resistance (RI) of the transfer roller 5 on the basis of the voltage applied. The DC high-voltage generator 18 applies a transfer voltage to the transfer roller 5 according to the estimated resistance (RI) of the transfer roller 5 when the toner image on the photosensitive drum 1 is transferred to the recording material P. It is characteristic of the contact image transfer method which transfers the toner image to the recording material P with contact the transfer roller 5 that (1) the optimal voltage to be applied to the front end of the recording material varies depending on the resistance value (RI) of the transfer roller, that (2) the resistance value (RI) of the transfer roller 5 varies largely, and that (3) the characteristic of the image transfer material varies largely between the high humidity environment and the low humidity environment. For this reason, the ATVC control is applied in order to keep the image transfer characteristic of the transfer roller 5 constant by discriminating the high humidity environment from the low humidity environment and vice versa. In this way, the application of the ATVC enables the constant voltage control to be applied according to the environmental condition.

Figure 3:
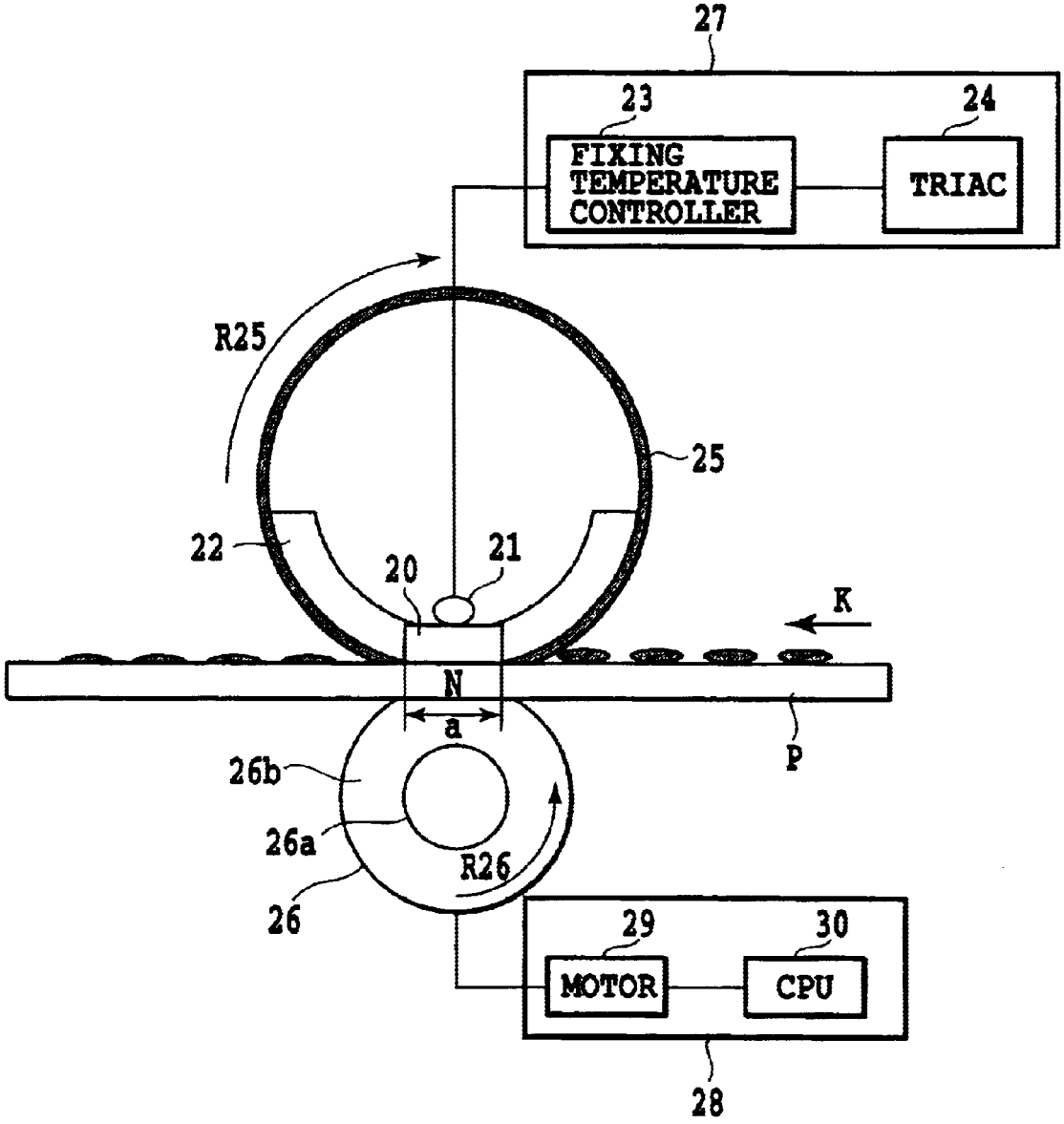
FIG. 3 is a composition diagram showing the image fixing unit incorporated into the image forming apparatus according to the present invention.

FIG. 3 shows the image fixing unit of the image forming apparatus according to the present invention. FIG. 3 is a sectional view by the vertical plane along the direction of transfer (in the direction of an arrow K) of the recording material P. The image fixing unit 11 comprises the main constituents such as a ceramic heater 20, as being a heater for heating the toner, a fixing film (a fixing rotor) 25 containing the ceramic heater 20, a pressure roller 26, as being another fixing rotor in contact with the fixing film 25, a temperature controller 27 for controlling the temperature of the heater 20, and a revolution controller 28 for controlling the transfer of the recording material P.

The heater 20 is supported with a guide member 22 (hereinafter referred to as "a heater holder") provided with the body M of the image forming apparatus. The heater holder 22 is a semicircular member made from a heat-resisting resin, and is designed for guiding the revolution of the fixing film 25.

The fixing film 25 is formed by molding the heat-resisting resin, e.g., polyimide resin or the like, into a cylindrical form and contains the heater 20 and the heater holder 22. The fixing film 25 is pressed against the heater 20 by means of a pressure roller 26, which will be described later, until the back surface of the fixing film 25 comes into contact with the bottom surface of the heater 20. The fixing film 25 is made to revolve in the direction of an arrow R25 as the pressure roller 26 revolve in the direction of an arrow R26. Both the left-hand side end and the right-hand side end of the fixing film 25 are regulated by a guide member (not shown) of the heater holder 22 so as to be prevented from deviating in the longitudinal direction of the heater 20.

The pressure roller 26 has a layer 26*a* formed from an elastic heat-resisting parting agent around the external circumference of a metal core 26*a*. The pressure roller 26 uses the external circumferential surface of the parting-agent layer 26*b* to press the fixing film 25 against the heater 20 and then provides a nipping section N between the pressure roller 26 and the fixing film 25.

The revolution controller 28 comprises a motor 20 for driving the pressure roller 26 and a CPU 30 for controlling the revolution of the motor 29. A stepping motor, for example, may be used as the motor 29. The motor 29 is designed not only for letting the pressure roller 26 revolve continuously in the direction of the arrow R26 but also revolve intermittently by predetermined angles. More particularly, the recording material P can be transferred step by step while the revolution and stop of the pressure roller 26 are repeated.

Temperature controller 27 comprises a thermistor 21 (a temperature sensing element) and a fixing temperature controller 23 for controlling the TRIAC 24 according to the temperature information obtained by the thermistor 21 and controlling the current to the heater 20.

The image fixing unit 11 is designed so that the revolution of the pressure roller 26 in the direction of an arrow R26 causes the recording material P to be nipped by the nipping section N to be transferred, while the toner on the recording material P is heated by the heater 20. In this case, the transfer of the recording material P is properly controlled as the revolution of the pressure roller 26 is controlled by means of the revolution controller 28. Further, the temperature of the fixing nipper section is properly controlled as the heating value of the heater 20 is properly controlled by the temperature controller 27.

Next, the basic operations that take place in the laser beam printer shown in FIG. 1 during the image forming process will be described. The laser beam printer starts the image forming operation upon receipt of the image signal from the host computer or the like. Initially, the photosensitive drum 1 is driven to revolve in the direction of the arrow R1 by means of the driver (not shown), while the surface of the photosensitive drum 1 is electrically charged uniformly with a specified polarity and a specified electric potentiality. The surface of the charged photosensitive drum 1 is exposed to the exposure light L by means of an exposure unit 3 incorporating a laser optical system or the like and according to the image information. When the charge of the area exposed to the light on the surface of the photosensitive drum 1 is removed, the electrostatic latent image is formed thereon according to the image information.

Next, the electrostatic latent image formed on the surface of the photosensitive drum 1 is developed by the development unit 4 to form the toner image on the photosensitive drum 1. In the development unit 4, the development bias is applied to the development roller 4*a* to have the toner deposited over the electrostatic latent image to effect the development of the toner image (visible image).

On the other hand, in parallel with the processing for forming the toner image on the surface of the photosensitive drum 1, the recording material P stored in the feed sheet cassette 7 is transferred as feed sheet by means of the feed sheet roller 15 and the transfer roller 8. The recording material P, after passing a top sensor 9, is transferred to the transfer nipping section (hereinafter referred to as "transfer nipping section) between the photosensitive drum 1 and the transfer roller 8. The recording material P has the front end thereof detected by the top sensor 9 and then undergoes the exposure process and the development process, which are synchronized with the formation of the toner image on the photosensitive drum 1. Hence, when the recording material P is transferred to the transfer nipping section, the toner image on the photosensitive drum is transferred onto the predetermined area on the recording material P owing to the effect of the transfer bias applied to the transfer roller 5.

In this way, the recording material P carrying the unfixed toner image on the surface thereof is transferred to the image fixing unit 11 along a transfer metal plate 10. The recording material P is transferred to the fixing nipper section formed between the heating roller 11*a* (with fixing film 25) and the pressure roller 11*b* pressed against the heating roller 11*a* (pressure roller 26). Unfixed toner image on the recording material P is heated and pressed by the image fixing unit 11 to be fixed on the surface of the recording material P. The recording material P with the toner image fixed thereon is transferred by the transfer roller 12 and is ejected onto an ejection tray 14 provided on the upper surface of the body M of the image forming apparatus by a sheet ejection roller 13.

The photosensitive drum 1, from which the toner image has been transferred, undergoes a cleaning process by which the toner remaining on the surface thereof is removed by a cleaning blade 6*a* of a cleaning unit 6. By repeating the operations described above the images for a plurality of pages can be formed on the recording material P.

Figure 4:
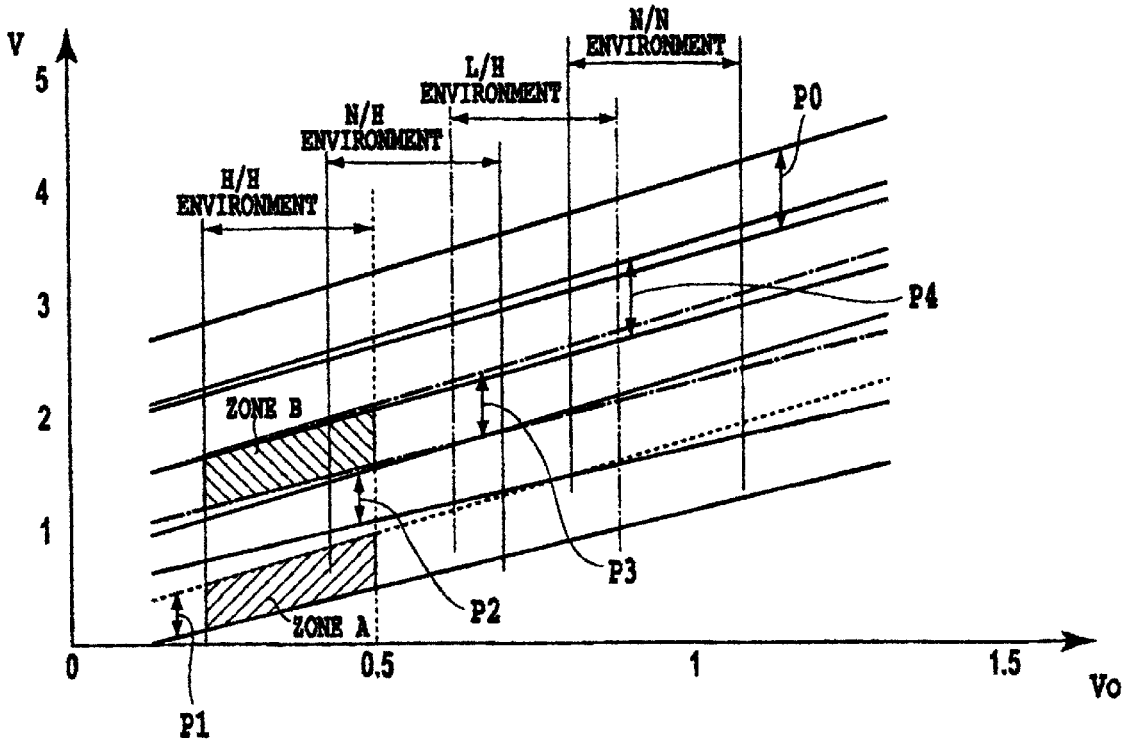
FIG. 4 is a diagram showing the voltages developed with the transfer roller during the ATVC control.

In the case of the laser beam printer as is described in the foregoing, in order for the setting of the temperature for the image fixing unit to be controlled properly according to the characteristic of the recording material, experiments were conducted by using a plurality of recording materials differing from one another in the hygroscopic property in a plurality of environments differing in the temperature and the humidity. FIG. 4 shows the voltages of the transfer roller 5 while being controlled by the ATVC. In the diagram $V_0$ on the x-axis represents the voltage of the transfer roller 5 during the constant current control at the time of the preceding revolution, while the V on the y-axis represents the voltage of the transfer roller 5 during the constant current control at the time of the image transfer.

For the experiments five types of recording materials are used. The recording material P0 is a fresh material immediately after being unpacked. The recording material P1 is placed in H/H environment for at least 12 hours. The recording material P2 is placed in N/H environment for at least 12 hours. The recording material P3 is placed in L/H environment for at least 12 hours. The recording material P4 is placed in N/N environment for at least 12 hours. A reason for being placed in different environments for at least 12 hours is that the water content of the recording material becomes stable.

FIG. 4 shows the $V_0$ vs. V relationship with respect to the upper limit and the lower limit thereof for each of the recording materials (P0–P4), as well as the ranges thereof in each of different environments (H/H, N/H, L/H and N/N). In this case, the environmental temperatures are given as H=38° C., N=23° C. and L=15° C., while the environmental humidities are given as H=80%, N=60% and L=10%, and the environmental conditions are given as the combinations thereof. For instance, the H/H environment represents a high-temperature and high-humidity environment where the temperature is 38° C., and the humidity is 80%, whereas the L/H environment represents a low-temperature and high-humidity environment where the temperature is 15° C., and the humidity is 80%. Further, the sizes of the recording materials P are limited to A4 size.

In FIG. 4, the diagram indicates that, when the environmental condition is varied in the order of N/N, L/H, N/H and H/H, the value of $V_0$ of the same recording sheet, which has been placed in the same environment, decreases. This indicates that the rise of the humidity causes the increase in the moisture of the transfer roller 5 and the moisture in the photosensitive drum 1 and resulting decrease in the resistance therein and that the value of the current can be kept at the same level even when the voltage impressed to the transfer roller 5 is lowered. The value of $V_0$ in the environmental condition such as the H/N condition, which is not indicated in the diagram, remains almost equal to that in the N/H condition, since the moisture of the transfer roller is almost equal to that in the N/H condition.

However, the value of V varies depending on the condition under which the recording material concerned is placed. Similarly to the moisture of the transfer roller 5, the value of V of the recording material decreases as the environmental condition varies in the order of N/N, L/H, N/H and H/H. In other words, this indicates the gradual increase in the moisture. For instance, when the recording material P1, which has been placed in the H/H environment, is transferred through the image forming apparatus placed in the H/H environment, the image transfer process comes to be controlled within the range of zone A, whereas when the recording material P3, which has been placed in the L/H environment, is transferred through the image forming apparatus placed in the H/H environment, the image transfer process comes to be controlled within the range of zone B. Within each of such zones, the x-axis represents the resistance of the transfer roller 5 and the dispersion of the DC high-voltage current generated by the DC high-voltage current generator, while the y-axis represents the kind of the recording material and the dispersion in the quality of transferred image depending on the kind of the recording material P and the kind of the image to be transferred.

Within the range of the zone A the level of the moisture in the recording material is so extremely high (when letting the recording material P1 undergo the image transfer process in the H/H environment), the recording material ejected onto an ejected sheet tray 14 tends to curl largely thereby extremely limiting the load capacity. Within the zone B the temperature of the recording material P is 15° C. (when letting the recording material P3 undergo the image transfer process in the H/H environment), while the hygroscopic property thereof is not as high as that of the recording material P1, and so the normal fixing temperature is required for the image fixing.

Figure 5:
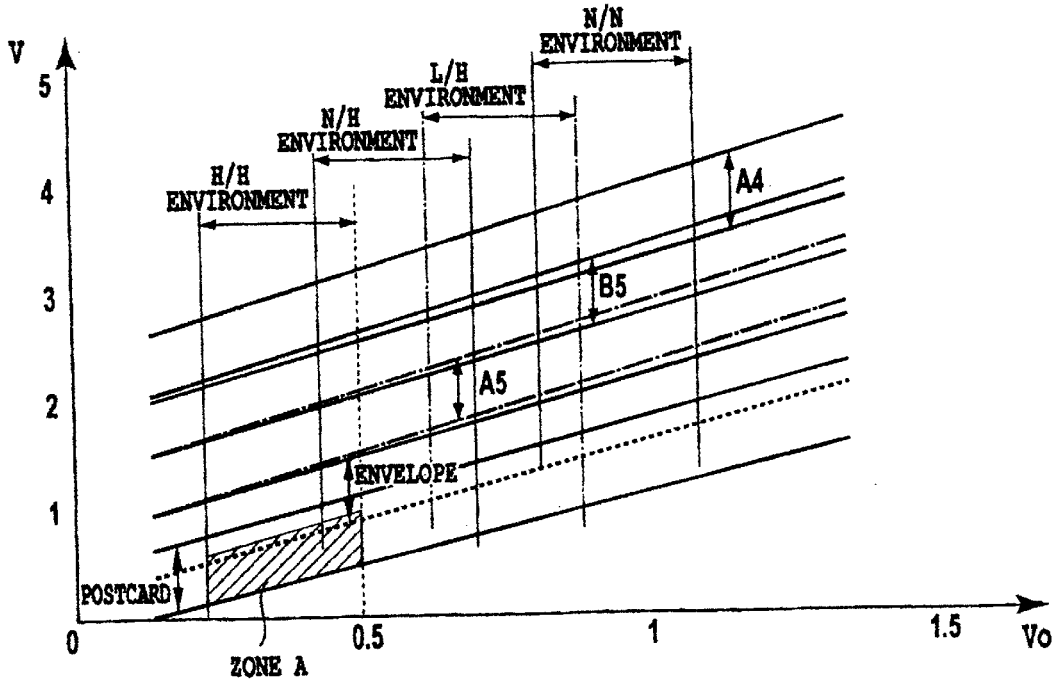
FIG. 5 is a diagram showing the relationship between the size of the recording material and the transfer voltage.

FIG. 5 is a diagram showing the relationship among the size of the recording material, the voltage $V_0$ and the voltage V, which are developed with the transfer roller 5. In this case, the recording material P0 is used. The recording material P0 is used immediately after being unpacked and having the moisture level of about 5%. Leaving the unpacked recording material in a highly humid environment results in a rapid increase in the moisture in a high-temperature environment while resulting in the decrease of the moisture in a low-temperature environment. Thus, in order to establish uniform conditions all the recording material P0 needs to be kept in bags to maintain the condition immediately after being unpacked. The sizes of the sheets range within postcard size, envelope size, A5, B5 and A4.

As shown in FIG. 5, the voltage V applied to the sheet to be processed during the transfer thereof decreases as the size of the sheet decreases. This condition will be illustrated by using FIG. 2. This condition is necessary, because, when processing the sheet of relatively small size, the decrease in the contact resistance (RII) occurs with respect to the area, which will not come into contact with the recording material, out of the nipping section formed between the transfer roller 5 and the photosensitive drum 1. Thus, depending on the situation, it is necessary for the transfer voltage to be controlled within the range of the zone A, since the transfer voltage is relatively low in the cases of small-size sheets such as the postcards and the envelopes.

Figure 6:
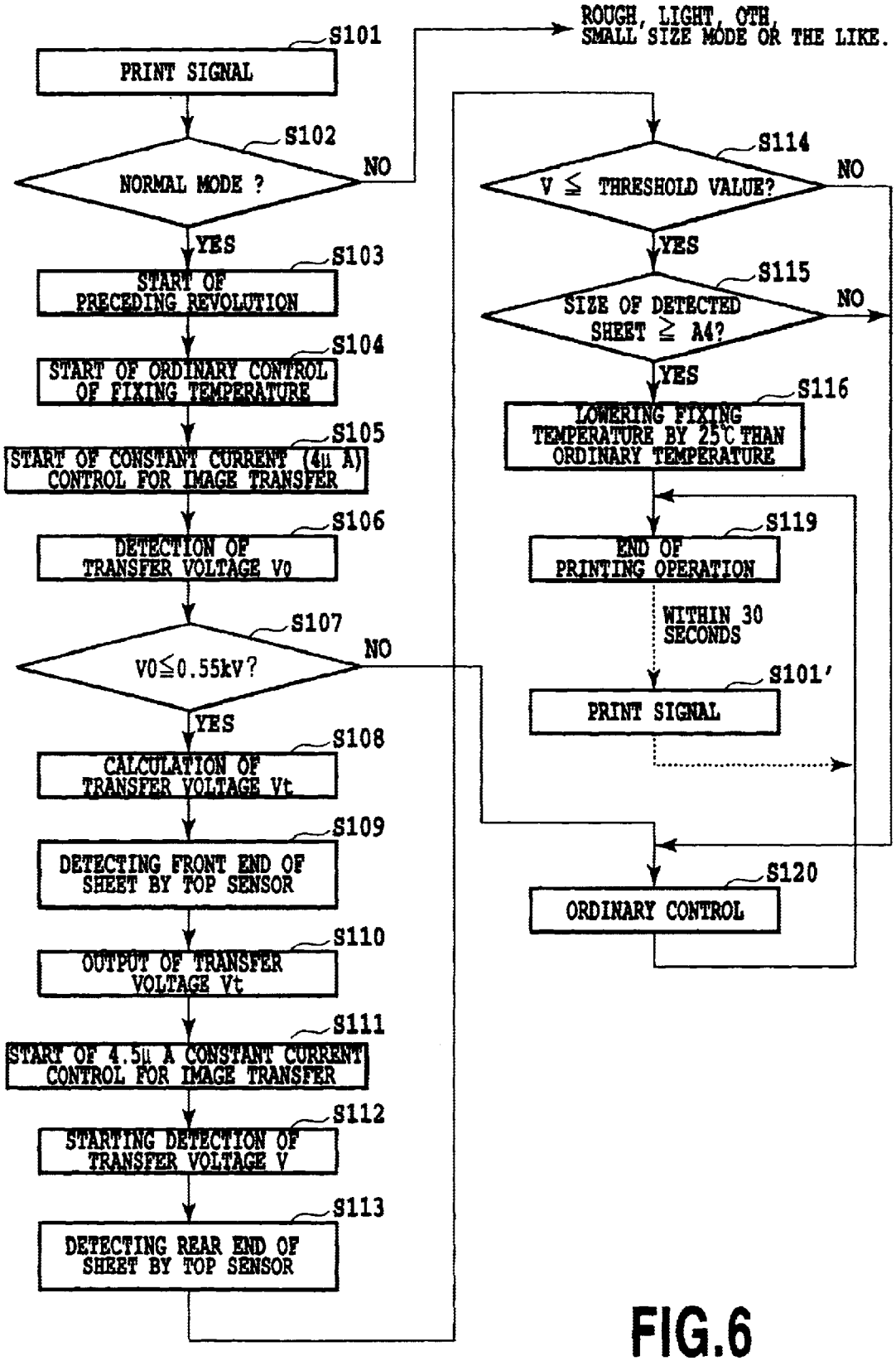
FIG. 6 is a flowchart illustrating the process of the temperature setting control of the image fixing unit incorporated into the laser beam printer according to the first embodiment of the present invention.

FIG. 6 shows the temperature setting process control for the image fixing unit 11 constituting the laser beam printer as the first embodiment of the present invention. In step 101, the signal for printing operation is received from an external apparatus such as the host computer. In step S102 whether or not the signal for printing is of normal mode. Further, whether or not the signal for printing is of normal mode is determined on the basis of the information describing the kind of recording material specified by the user. Where the rough sheet, light sheet, OHT, small-size sheets or the like are specified as the recording materials for printing, the determination is made for NO, and the processing proceeds to the control mode predetermined according to the kind of the recording material.

In step S102, when the normal mode is applied (when it is determined that the recording material is not specified by the user), the preceding revolving operation is started for setting the conditions for permitting the operations of various units such as the charging unit, an exposure unit, an image developing unit, an image transfer unit or the like constituting the laser beam printer (Step S103).

In step S104, the normal control of the fixing temperature is started. In order for the normal control of the fixing temperature to be effected, the temperature of the image fixing unit is detected by the temperature detection element 21 to set a target temperature according to the detected temperature thereby to control the current to heater 20. For instance, where a plurality of control temperatures are applicable, when the temperature detected by the temperature detection element 21 is 45° C. or less, the target temperature is set to 215° C.; when the detected temperature is within 45° C. to 80° C., the target temperature is set to 210° C.; when the detected temperature is within 80° C. to 120° C., the target temperature is set to 205° C.; when the detected temperature is 120° C. or more, he target temperature is set to 200° C.

In step S105, the constant current control with fixed current value I (4 $\mu$A according the present embodiment) is started for the transfer roller 5. In step S106, the voltage $V_0$ developed with the transfer roller 5 during the constant current control is detected and stored in a memory (not shown). The current I flows to the ground through a metal core 5*a*, an elastic layer 5*b*, a transfer nipper section and the photosensitive drum 1 while voltage is applied to the metal core 5*a*. In order for a fixed current (4 $\mu$A according to the present embodiment) to be supplied from the transfer voltage controller 19, the output of the DC high-voltage generator 18 is controlled to the previously mentioned value $V_0$. Further, the value of $V_0$ may be obtained by averaging a plurality of the values of $V_0$ obtained by the sampling made at predetermined intervals. Further, the constant current control, started in the step S105, is discontinued after detecting the voltage $V_0$.

In step S107, the voltage $V_0$, detected in the step S106 is compared with the predetermined voltage (0.55 kV in the case of the present embodiment). Further, the voltage, 0.55 kV, is experimentally obtained voltage as illustrated in FIG. 4 and is used as a criterion for determining whether or not the environment of the laser beam printer is H/H environment. When the detected voltage $V_0$ is 0.55 kV or less, the processing proceeds to step S108.

In the step S108, in order for the toner image to be transferred onto the recording material, the voltage Vt to be applied to the transfer roller 5 is calculated. Further, in order to prevent insufficient supply of the current at the front end of the recording material, Vt is calculated on the basis of the $V_0$ obtained by the preceding revolution. The Vt=2.5V+0.5 in the case of the present embodiment. In the present embodiment, an optium control formula is applied depending on the transfer roller, the high-voltage circuit or the like to be employed.

In step S109, when the front end of the recording material P is detected by the top sensor 9, the detection signal from the top sensor 9 is inputted to the transfer voltage controller 19. The transfer voltage controller 19 determines whether the front end of the recording material has entered the image transfer nipping section on the basis of the detected signal from the top sensor 9. Further, the transfer voltage controller 19 controls the DC high-voltage generator 18 so that the transfer voltage Vt can be made available prior to the entry of the front end of the recording material into the image transfer nipping section.

In step S110, the DC high-voltage generator 18 applies the transfer voltage Vt to the transfer roller 5. The transfer voltage Vt is set to range between 2.5 kV and 5 kV in the ordinary environment (the resistance of the transfer roller 5 ranges between $10^6\Omega$ and $10^{10}\Omega$). In step S111, the constant current control is started after several hundred milliseconds (about 150 msec in the case of the present embodiment) following the output of the transfer voltage Vt. In step S112, the DC high-voltage generator 18 starts the detection of the transfer voltage V to be applied to the transfer roller during the constant current control. I step S113, the rear end of the recording material, whose front end has already been detected in step S109, is detected.

In step S114, the transfer voltage V, whose detection has already been started in the step S112, is compared with threshold value thereof. The threshold voltage is calculated by using the control formula adopted from the experiment described previously in FIG. 4 ($1.5V_0$+0.2 in the case of the present embodiment). Further, the transfer voltage V needs to be detected before the front end of the recording material, which has already passed the image transfer nipper section, enters the nipper section of the image fixing unit 11. Meeting this requirement is important in order for the condition of the recording material to be examined accurately before entering into the fixing nipper section. Meeting this requirement is also necessary to define the position for detection, since transfer voltage is subject to vary largely depending on the transferred position of the recording material.

For instance, when the bias −600V is applied to the image fixing unit 11, the transfer of a low-resistance recording material into the fixing nipper section of the image fixing unit 11 causes the image transfer current to flow into the image fixing unit 11 through the recording material. This causes the transfer voltage to vary sharply simultaneously with the entry of the recording material into the fixing nipper section. This situation results from that the entry of the front end of the recording material P into the fixing nipper section causes the part of the image transfer current flowing through the photosensitive drum 1 to flow, as a leakage current, into the image fixing unit 11 through the recording material. This situation is caused by that the potentiality of the resistance RIV, shown in FIG. 2, becomes potentially low when the recording material P is introduced into the fixing nipper section. In the present embodiment, the transfer bias is controlled by the constant current control, so that, when the front end of the recording material P enters into the fixing nipper, the output of the transfer voltage is controlled to a lower level. Needless to say, as long as the high-voltage transfer bias with a constant voltage is outputted, the image transfer current increases when the front end of the recording material enters into the image fixing nipper.

In the present embodiment, the distance between the image transfer nipper to the image fixing nipper is 70 mm, and the processing speed is set to 100 mm/sec. Thus, the recording material enters into the fixing nipper after about 700 msec from starting to apply the transfer voltage. At the front end of the recording material, the image transfer current varies sharply, thereby causing the transfer voltage to become unstable. Thus, in the present embodiment, the output voltage V is detected between 300 msec and 700 msec after starting to apply the transfer voltage.

In the present embodiment, the constant current control is applied 150 msec after starting to apply the voltage Vt, and, for example, the transfer voltage V can be compensated for every several tens msec by comparing the monitored image transfer current with the predetermined current. Needless to say, the comparison on the basis of the current is possible, provided that proper constant voltage control is available.

In step S114, if the transfer voltage V is found o be lower than the threshold voltage ($V \leqq 1.5V_0+0.2$), this indicates that the recording material P1 has been placed in H/H environment and having a high hygroscopic property, and so the processing proceeds to step S115. In the step S115, whether or not the size of the sheet is in accordance with or larger than the predetermined size. Further, in the present embodiment, the size of the sheet (e.g., A4 or B4) is detected by means of the top sensor 9 at the point when the recording material passes the top sensor 9. Besides, a plurality of sensors may be provided along the direction orthogonal to the direction of the transfer of the recording material to directly measure the width of the recording material. Further, the size of the recording material may be measured by means of a plurality of temperature detection elements 21 provided along the direction orthogonal to the direction of the transfer of the recording material in the image fixing unit so that the size of the recording material can be detected by monitoring the change of the temperature owing to the passage of recording material.

In step S115, if the size of the sheet is found to be larger than A4 size (YES), the processing proceeds to step S116 for the processing for altering the fixing temperature from the ordinary fixing temperature. Thus, since it is designed that the fixing temperature is altered only when the size of the sheet is found to be A4 or larger, the fixing temperature will not be altered with the passage of small-size recording materials such as the postcard, envelop or the like (NO).

In the step S116, the fixing temperature is uniformly lowered by 25° C. from the ordinary set temperature. Further, in the case of the present embodiment, it is desired to alter the fixing temperature after completing the image fixing processing of the recording material whose size has been detected. In the arrangement according to the present embodiment, the size of the recording material can be identified only after detecting the rear end of the recording material P by the top sensor 9. At this point, the front end of the recording material P is in the vicinity of the fixing nipper section, and thus it is not possible to secure a sufficient time for stabilizing the fixing temperature after having been altered. Further, depending on the size of the recording material, the front end of the recording material P has already entered into the fixing nipper section, and thus altering the fixing temperature while the sheet is in transfer can give adverse effects on the quality of the image on the recording material.

Figure 7:
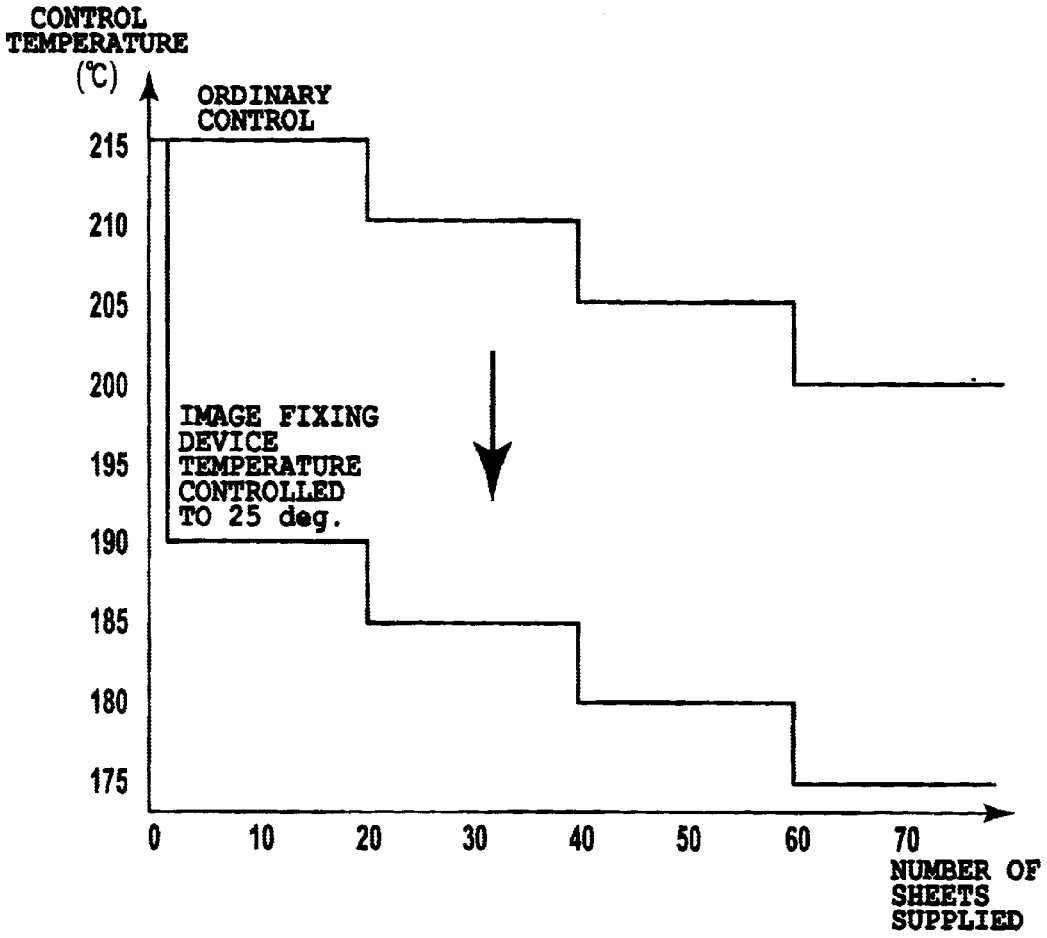
FIG. 7 is a diagram exemplifying the temperature setting for the temperature setting control.

FIG. 7 shows an example of the set temperatures for the temperature setting control. In the ordinary control, for the image fixing by the image fixing unit and the control of the heater temperature, some different optimum temperatures are predetermined so that the appropriate temperature can selectively applied depending on the necessity or according to the predetermined sequence. For instance, when starting the image forming operation of the laser beam printer, after having been left unoperated for a certain period of time with the power source thereof turned off (e.g., Starting the image forming operation of the laser beam printer when the temperature detected by the temperature detection element 21 is 45° C. or lower is called the cold start), normally the temperature should be set to 215° C. In this situation, when the recording material is found to have the A4 size in the step S115, and the fixing temperature needs to be altered in the step S116, the temperature should be set to 190° C. In other words, when the recording material (A4 or larger in size) having a high moisture level has to be supplied in a high-moisture environment wherein the load capacity is poor, the temperature is set to 190° C., which is lower by 25° C. than the ordinary set temperature, for the recording material to be supplied subsequently.

Further, when resuming the image forming operation within a certain time interval after the preceding image forming operation was over (e.g., Starting the image forming operation when the temperature detected by the temperature detection element 21 is 45° C. or higher is called the hot start), or when a number of sheets exceeding a certain number are supplied, the ordinary set temperature may be set to the temperatures such as 210° C., 205° C., 200° C. and so on. In such a case, in the processing for altering the set temperature, the (operating) temperature is set to 185° C., 180° C. or 175° C., which are lower by 25° C. the ordinary temperatures.

In the step S119 shown in FIG. 6, the printing operation of the laser beam printer completes. However, when a new print signal is received within a predetermined time (30 seconds in the case of the present embodiment) after finishing the processing in the step S119, the image forming operation is resumed with the set temperature, which is lower by 25° C. the ordinary temperatures, of the image fixing unit 11 remaining intact.

The processing of step S120 is executed when the result of the determination was NO in the step S107 (determined to be a high-temperature and high-humidity environment), and when the result of the determination in the step S114 was NO (when the recording material P1 is not found).

Here, the explanation will be made as to the reason for that the set fixing temperature is altered to the temperature that is lower by 25° C. than the ordinary temperature. FIG. 8 shows the condition, the loading ability dependent on the fixing temperature and the fixing ability of the recording material. FIG. 8A shows the degree of curling and the loading capacity of the recording material P1, measured on the basis of the set temperature for the control of the fixing temperature during the image fixing operation of the image forming apparatus placed in the H/H environment. FIG. 8A also shows the results of the measurements of the degree of curling and the number of the recording materials fallen from the ejected sheet tray (the falling number) with respect to the sheet type 1 and the sheet type 2 under the condition where the fixing temperature is lowered gradually to different levels from the ordinary fixing temperature. Further, it should be noted that the type 1 sheet and the type 2 sheet differ in characteristics such as the thickness, area or the like. The falling number means the limit for the continuous loading of the recording materials beyond which the loaded sheet starts falling down from the tray. The increase in the degree of curling of the recording materials tends to decrease the falling number of the recording materials.

The degree of curling increases as the pint rate decreases (i.e., similar to white image). The print rate means the percentage of dots of image printed on one page. In the case of the present experiment conducted under the cold start condition, 20 sheets of the recording material P, each having 3% print rate (the print rate almost equivalent to the white sheet) were outputted. The degree of curling was measured by measuring the distances among the four corners of each sheet after placing flat the outputted sheets on a flat board for 1 minute. The degree of curling of the sheet with the image fixed thereon tends to decrease as the fixing temperature lowers. Thus, some kinds of sheets scarcely curl where the fixing temperature is set to the levels lower by 20° C. than the ordinary fixing temperature (e.g., 195° C. to 180° C.). It was found that, even those kinds of the sheets which tend to curl more than other kinds of sheets, up to 100 sheets can be loaded on the ejected sheet tray where the fixing temperature is set to the level lower by 25° C. than the ordinary fixing temperature (e.g., 190° C. to 175° C.).

FIG. 8B shows the relationship between the image density deterioration ratio and the fixing stability with respect to the recording material P1, while FIG. 8C shows the relationship between the image density deterioration ratio and the fixing stability with respect to the recording material P3. FIG. 8C also shows the relationship between the measured image density deterioration ratio and the measured fixing stability of the type 1 sheet and the type 3 sheet where the fixing temperature is set to gradually lower levels than the ordinary fixing temperature. Further, the type 1 sheet and the type 3 sheet differ in surface condition. The fixing stability is qualitatively worst in the case of the half-tone image. With this fact in mind, in the case of the present experiment, the 5 sheets of the recording material carrying the half-tone images printed thereon were outputted from the cold-started image forming apparatus. In this experiment, the image density deterioration ratio is measured by comparing the density before printing with the density after printing. In the case of the type of sheet whose fixing stability is poor, the result of the image fixing experiment conducted at the temperature (185° C. to 170° C.), which is lower by 30° C. than the ordinary fixing temperature and in the H/H environment, has been found to be NG (density deterioration ratio being 10% or more on the average), and so it can be concluded that the fixing temperature in this case should be the ordinary fixing temperature −25° C. or higher (i.e. 190° C. to 175° C.).

Further, as seen from FIG. 8C, in the recording material P3, the result of the image fixing even at the temperature equivalent to the ordinary fixing temperature −25° C. is found to be NG. Thus, the image fixing control, which is good enough for assuring sufficient load capacity, is available only for the recording material P1 when the image fixing control is applied at the ordinary temperature −25° C. Further, since the ordinary control is applicable to the recording material P3, the fixing stability is not affected adversely.

According to the present embodiment, the setting of the temperature for the image fixing unit can be controlled properly according to the size of the recording material without adversely affecting the specifications for the ordinary operation, thereby contributing to the improvement of the load capacity in the high-temperature environment.

(The Second Embodiment)

The second embodiment is designed so that the fixing temperature can be altered according to the width of the recording material by employing the sensor capable of directly detecting the width of the recording material P. In the laser beam printer, the print signal includes the information on the recording material P. With such information, for example, the operation mode suiting the characteristic of the recording material such as the OHT sheet, small-size sheet (postcard, envelope, etc.) can be set on the side of image transfer control section and the image fixing control section.

However, when the print signal is not included in the information on the recording material P, the feed of the recording material having a small size and a large thickness causes the drop of the transfer voltage V. Such situation results from the increase in the blank contact area between the transfer roller 5 and the photosensitive drum 1 owing to the area of the recording material to be inserted being too small and the resulting decrease in the value of resistor RII (see FIG. 2). Further, the large thickness of the recording material and resulting large heat capacity tends to adversely affect the fixing stability of the image.

In the first embodiment, the load capacity of the recording material P is improved by introducing a process in which the recording materials having the size of A4 or more are detected to compare the transfer voltage V with the threshold value calculated based on the voltage $V_0$. and reducing the fixing temperature for the recording material P1. The second embodiment is designed so that the width of the recording material P can be detected directly by the sheet size sensor so as to obtain the effect of the first embodiment. Also, in the second embodiment, the threshold value of the transfer voltage V is calculated in consideration of the detected width of the recording material P so that the calculated threshold value can be compared with the transfer voltage V to alter the fixing temperature.

In the second embodiment, the recording material path is provided with a plurality of width sensors 9' installed along the direction orthogonal to the direction of the transfer of the recording material besides the top sensor 9. Thus, the width of the recording material can be detected depending on the ON or OFF state of the plurality of width sensors 9'. Further, it is also possible to detect the size of the recording material by providing, instead of the width sensors, a plurality of temperature sensors in the direction orthogonal to the direction of the transfer of the recording material in the image fixing unit 11 so that the size of the recording material can be detected by monitoring the rise of the temperature resulting from the passage of the recording material.

For instance, the temperature sensors 21, 5 sensors in total, are provided at the center of the recording material P path area; in the path of the envelope not permitting the passage of postcard size sheet; the path of A5 size sheet not permitting the passage of envelope size sheet; the path of B5 size sheet not permitting the passage of A5 size sheet; the path of A4 size sheet not permitting the passage of B5 size sheet. Thus, in the fixing temperature controller 23, the width of the recording material can be detected by monitoring the rise of the temperature of a plurality of the temperature sensors 21 while the recording material is passing the fixing nipper section. Where it is not possible to install the plurality of the temperature sensors 21, the temperature sensor 21 may be installed at the center and the positions corresponding to the ends of the recording material path respectively to estimate the width of the sheet on the basis of the rise of the temperature at the positions corresponding to the ends of the sheet.

Figure 9:
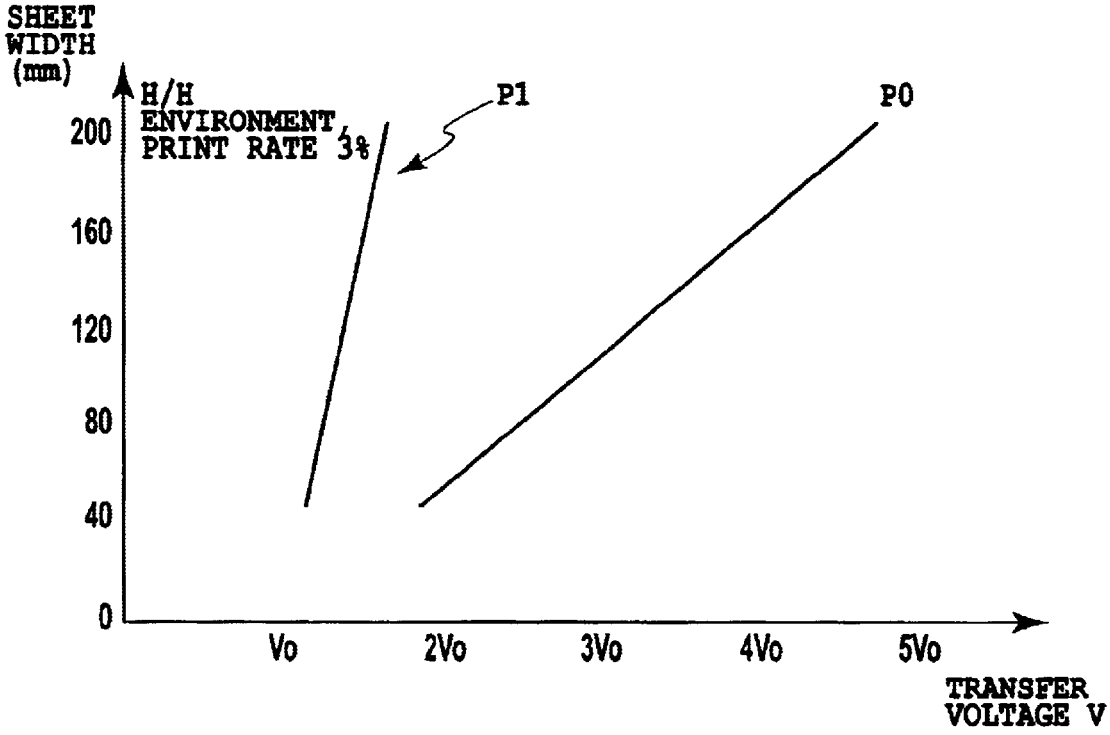
FIG. 9 is a diagram showing the relationship between the width of the recording material and the transfer voltage V.

FIG. 9 shows the relationship between the width of the recording material and the transfer voltage. In the diagram of FIG. 9, the transfer voltage V is plotted on the x-axis, while the width of the recording material is plotted on the y-axis. In the case of the recording material P1, the relationship, i.e., Transfer voltage $V \approx V_0$+sheet width$\times V_0/400$ holds, whereas, in the case of the recording material P0, the relationship, i.e., Transfer voltage $V \approx V_0$+sheet width$\times V_0/50$ holds.

In the case of the first embodiment, the threshold value is set to $1.5V_0+0.2$, whereas in the case of the second embodiment, the threshold value is set variable depending on the width of the sheet, and this relationship is expressed as $$\text{Threshold value}=1.5V_0+0.2V_0-V_0\times(200-\text{sheet width (mm)})/100$$

Of course, the above equation needs to be optimized depending on the sheet size detection method, the characteristic of the transfer roller 5 or the performance of the high-voltage circuit.

Further, the image fixing control temperature is stored even after finishing the printing operation. Where it is so set that recording sheet is supplied within 30 seconds, the recording sheet supplied in such a fashion can satisfy required loading ability even if the sheet is outputted intermittently. In so far as the recording sheet is supplied within 30 seconds, necessary fixing stability can be maintained even if the temperature of the heater is lower than the normal level, since the image fixing unit is kept hot (the temperature of the image fixing unit 11 is kept at 45° C. or higher).

The second embodiment provides an optimum image fixing process control suiting the ordinary sheets and the small-size sheets having the qualities satisfying the requirements of the load capacity in the high-temperature environment without causing poor image fixing result even for the small-size sheets such as the postcard and the envelope.

(A Third Embodiment)

The third embodiment is designed for enabling the set temperature of the image fixing unit to be properly controlled depending on the print rate of the recording material P. The transfer voltage, which has been discussed in connection with the first embodiment and the second embodiment, tends to rise to a high level owing to the effect of the resistance (RII) of the toner on the recording material when the printed image includes the dark image which contributes to the increase in the print rate compared with the case of the recording material P carrying the image of relatively lower print rate.

Figure 10:
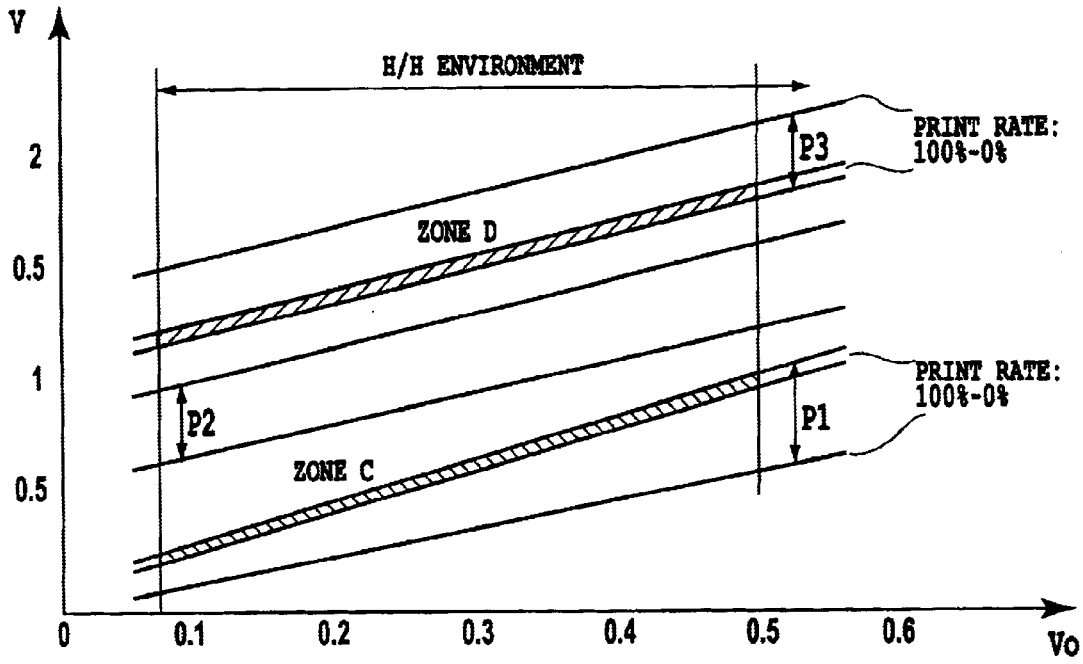
FIG. 10 is a diagram showing the relationship between the print rate of the recording material and the transfer voltage.

FIG. 10 shows the relationship between the print rate of the recording material P and the transfer voltage V. Among various recording materials P1–P3 varying in the hygroscopic property, those having higher print rate within each of the zones are at higher position. On the other hand, those having lower print rate within the zones are at lower position because of resistance of the recording material P only. Therefore, it happens that transfer voltages become equal depending on the print rate even when the environments (in which the recording materials concerns P have been left) or the hygroscopic properties thereof differ. Even within the H/H zone A shown in FIG. 4, the image whose print rate is 80% or higher (within which the slippery condition is apt to occur) is close to the upper limit thereof (within the zone C of FIG. 10). Also, it can be noticed that, the image, whose print rate is relatively low (e.g., the half-tone images whose image fixing abilities are poor), is within the zone D and close to the lower limit. This is because the resistance of the toner as shown in FIG. 2 affects the transfer voltage V.

Figure 11:
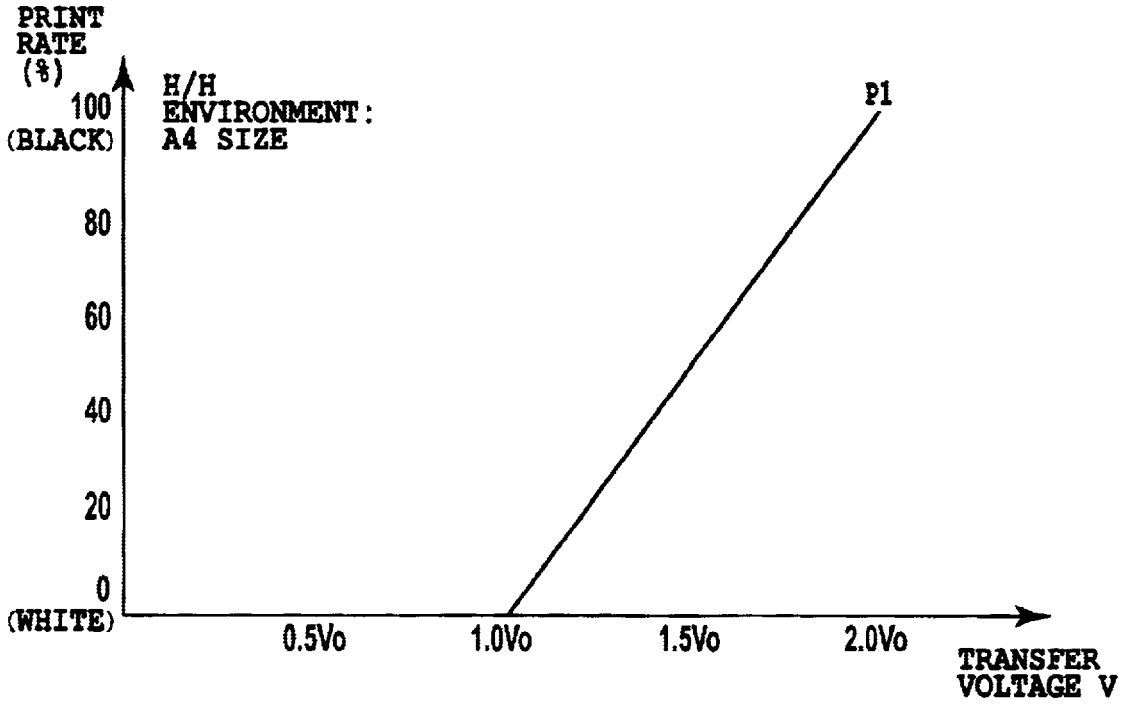
FIG. 11 is a diagram showing the relationship between the print rate on the sheet left in H/H environment and the transfer voltage V.

FIG. 11 shows the relationship between the printed image ratio of the recording material P1 and the transfer voltage. The higher the print rate, the higher the transfer voltage V, whereas, the lower the print rate, the lower the transfer voltage V. The transfer voltage can be expressed as $V \approx V_0\times$ printed image ratio (%)/100+$V_0$. In this equation, $V_0$ is the value to be detected when the recording material P1 with A4 size is supplied in the H/H environment.

The print rate can be obtained based on the size of the recording material P and the number of dots of the printed image. The number of the dots of the printed image can be obtained according to the procedure described below. For instance, assume that the black pattern on the image is represented by 1 in relation with the image signal Y, while the white pattern is represented by 0. In this case, when the image signal Y is 1, the laser diode in the exposure unit 3 is turned ON synchronously with the reference clock signal. Accordingly, the counted value of the reference clock signal, in the period during which the image signal Y is 1, becomes equal to the number of dots of the optical signal outputted from the laser diode. The total number of the printed dots can be obtained by counting the reference clock signals, i.e., by adding the dots forming the latent image.

Figure 12:
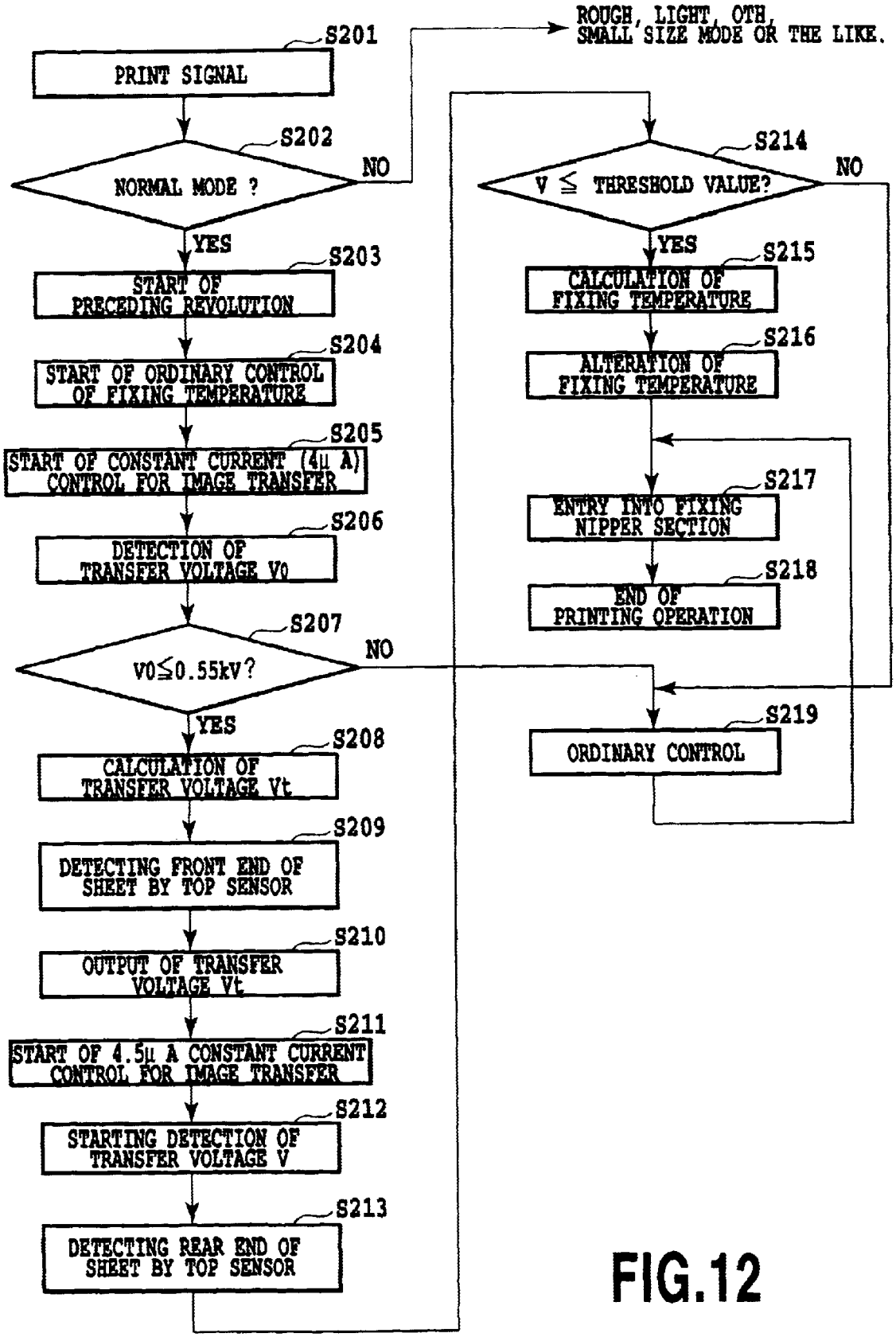
FIG. 12 is a flowchart illustrating the image transfer process control and the image fixing process control according to the third embodiment of the present invention.

FIG. 12 shows the process for controlling the image transfer operation and the image fixing operation of the image forming apparatus relating to the third embodiment of the present invention. The descriptions of those operations ranging from step S201 to step S212 are omitted since being similar to those ranging from the step S101 to the step S112. However, in the case of the first embodiment, the print signal is explained as not including the information concerning the print rate and the size of the recording material. In the third embodiment, it is premised that the print signal includes the information on the print rate and the sheet size. Thus, it is possible to raise the slip margin before the recording material enters into the fixing nipper section while maintaining the necessary fixing stability by altering the settings for the fixing temperature control including the above-mentioned information.

In the case of the third embodiment, in the step S213, the equation given below is applicable, that is, $$\text{Threshold value}=1.5V_0+0.2-V_0\times(200-\text{sheet width (mm)})/100+0.4V_0\times\text{print rate (\%)}/100$$

is used to obtain the threshold value on which whether the fixing temperature needs to be altered or not is determined. By applying this threshold value calculation formula the fixing stability can be satisfied even in the case of dark image having a high print rate, which is unfavorable to the slip, the down zone of the fixing temperature can be extended so that the fixing stability of the half-tone image on the recording material P3 and poor in the image fixing potentiality.

In the step S214, the transfer voltage, the detection of which is started in the step S212, is compared with above-mentioned threshold value. When the transfer voltage is found to be lower than the threshold voltage, the processing proceeds to the next step S215 for calculating the fixing temperature. In the first and the second embodiments, when the threshold value is detected, the fixing temperature control, in which the fixing temperature is set lower by 25° C. the ordinary set temperature, is applied. In the third embodiment, the fixing temperature is altered by stages. Further, in the third embodiment, the target temperature is set as Target temperature=ordinary temperature−50× (threshold value−transfer voltage V) on the condition that 0.5 kV≧threshold value−transfer voltage≧0 (in the case of third embodiment, the transfer voltage will not become less than $V_0$, since a lower limit is set for the transfer voltage $V_0$).

This calculated temperature is altered in the step S216, which precedes the entry of the recording material into the fixing nipper section.

In the first embodiment, the size of the sheet can be identified only when the rear end of the sheet is identified by the top sensor 9. However, at this point, the front end of the recording material is in the vicinity of the fixing nipper section, so that it is hard to secure the time sufficient for stabilizing the altered fixing temperature. In the first embodiment, therefore, the fixing temperature is altered after the image fixing process of the recording material is finished rather than altering the fixing temperature of the recording material which is the object the detection of the size at this point.

However, in the third embodiment, it is premised that the print signal includes the information on the print rate and the sheet size, so that it is possible to alter the fixing temperature with sufficient time before the front end of the recording material enters into the fixing nipper section. Thus, it is desired to alter the fixing temperature with respect to the recording material as an object of the detection of the size.

In the step S217, the recording material enters into the fixing nipper section to complete the printing process in step S218. Further, the processing in step S219 is executed when the given situation has been determined to be NO in step S207 (i.e., where the environment has been determined not to be the H/H environment), and where the given situation has been determined to be NO in step S214.

By designing the processing as described above, it can be made possible to properly control the temperature setting of the image fixing unit depending on the print rate of the recording material, thereby enabling the imaging forming apparatus being free of the sheet jamming and poor image formation to be provided.

(A Fourth Embodiment)

Figures 13, 13A:
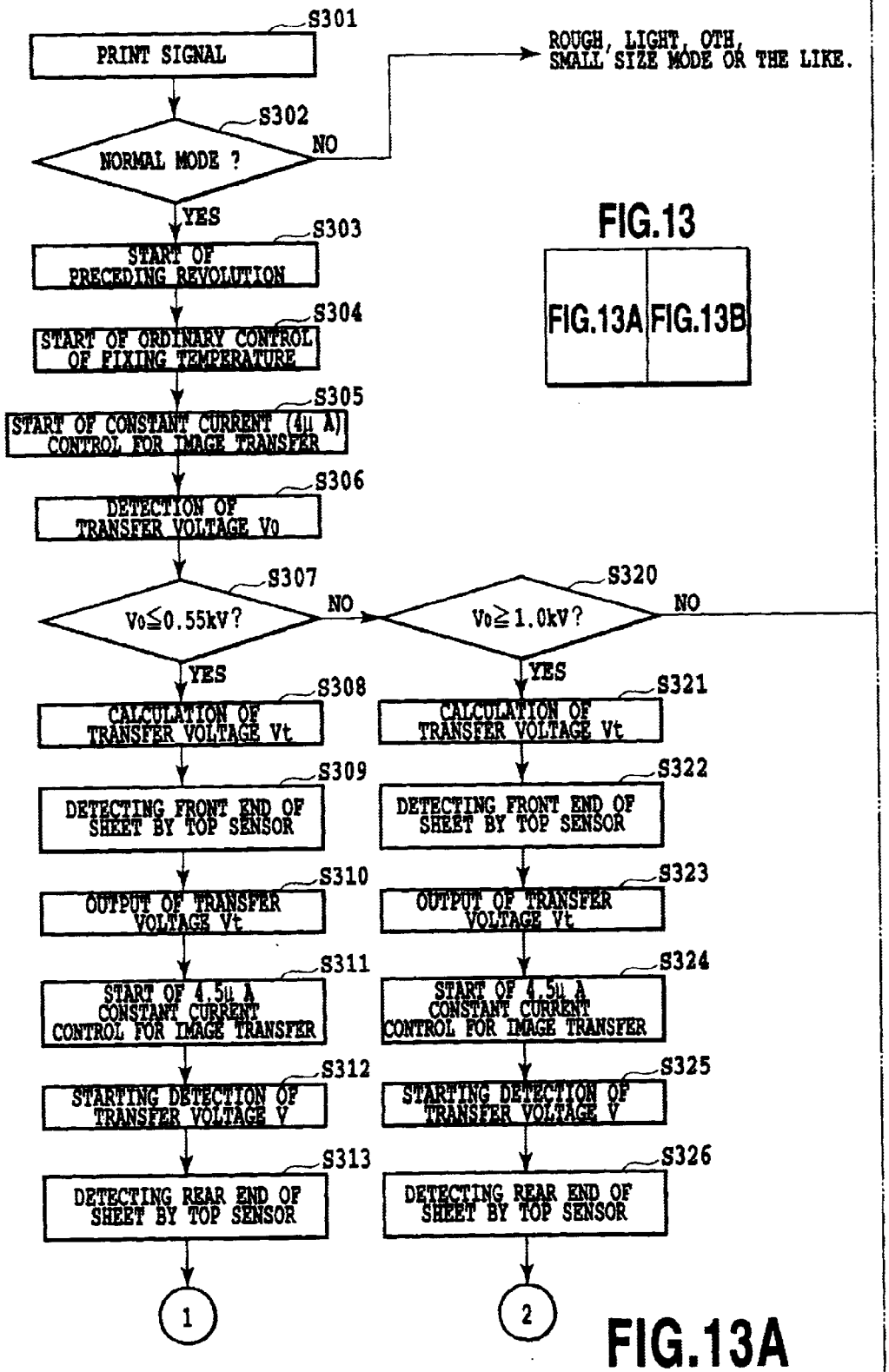
FIGS. 13A and 13B are flowcharts illustrating the temperature setting control for the image fixing unit 11 incorporated into the laser beam printer according to the fourth embodiment of the present invention.
Figure 13B:
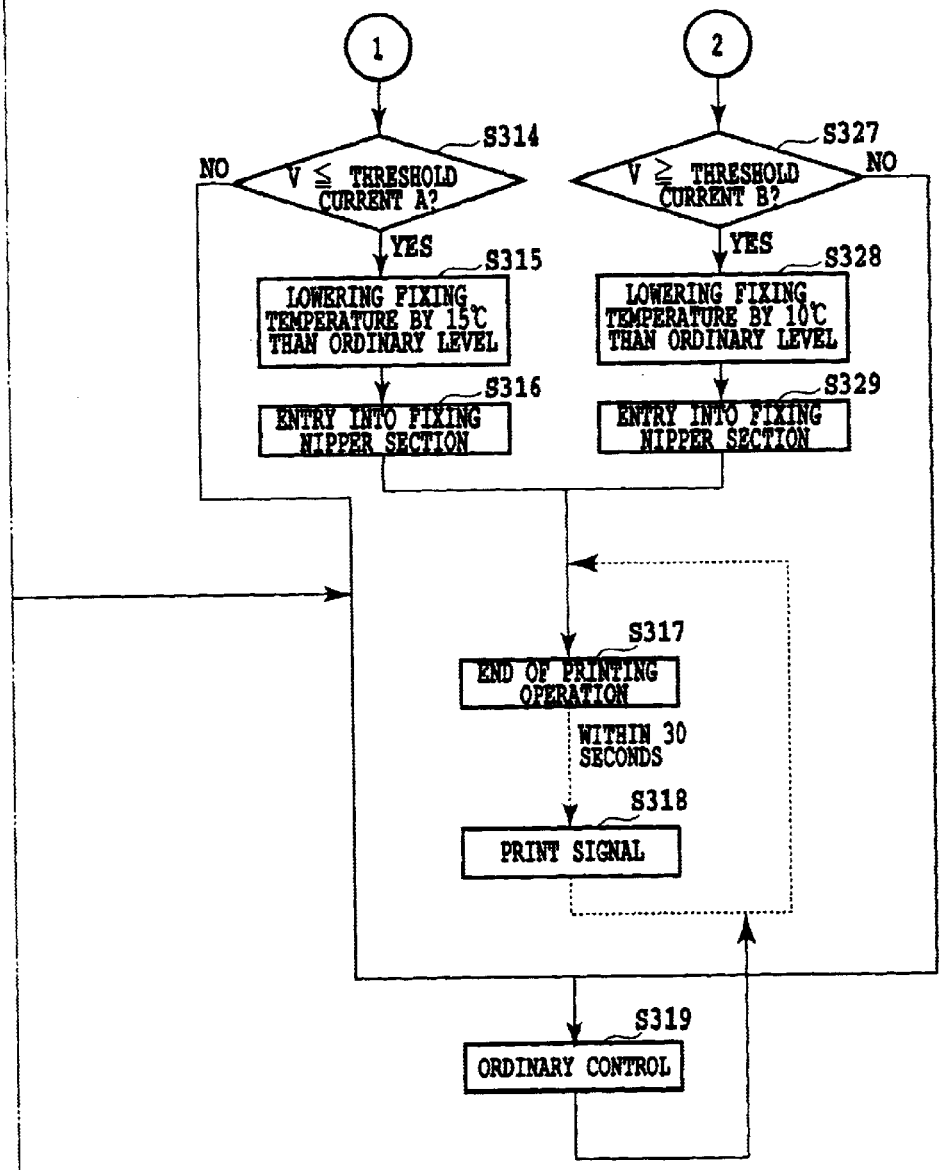

FIGS. 13A and 13B show the process of the temperature setting control for the image fixing unit 11 in the laser beam printer. The fixing temperature control process discussed in the case of the third embodiment is designed so that the threshold value is calculated based on the characteristics (i.e., the size, print rate, etc.) of the recording material to determine whether the fixing temperature needs to be altered or not by comparing the threshold value with the transfer voltage while the image transfer onto the recording material is in progress. In the previous discussion, the alteration of the fixing temperature is concerned with the fixing temperature control by lowering the ordinary fixing temperature. In the case of the fourth embodiment, in consideration of that the fixing stability extremely declines in the low humidity environment (or low temperature environment), the control method is designed so that the fixing temperature can be either raised or lowered depending on the given environment.

The operations in the steps ranging from step S301 through step S319 are similar to those in the steps ranging form the step S201 through the step S219 given in FIG. 12. However, the steps in the fourth embodiment differ from the steps in the third embodiment in that the lowering range of the fixing temperature is up to 15° C. in the case of the fourth embodiment, while the same is up to 25° C. in the case of the third embodiment. Further, the operations being characteristic of the fourth embodiment will be described mainly referring to the operations taking place in the steps ranging from the step S320 to the step S328.

The step S307 examines whether the given environment is a high-humidity environment or not on the basis of the value of the transfer voltage $V_0$. When the given environment is found not to be a high-humidity environment or found to be an ordinary environment or a low-humidity environment, the operation will not go to the ordinary control as in the case of the third embodiment but proceeds to the step S320. The step S320 examines whether the given environment is an ordinary environment or a low-humidity environment on the basis of the value of the transfer voltage $V_0$. More specifically, when the transfer voltage $V_0$ is found to be 1.0 kV or more, the given environment is determined to be a low-humidity environment, and the processing proceeds to the step S321. Further, when the transfer voltage is within the range of 0.55 kV to 1.0 kV, the given environment is determined to be an ordinary environment, and the processing proceeds to the ordinary control in the step S319.

The operations taking place in the steps ranging from the step S321 to the step S326 are similar to those taking place in the steps ranging from the step S308 to the step S313 except the formula applied for the calculation of the threshold value. In the step S327, whether the transfer voltage V is higher than the threshold value B or not, and, when the V is found to be higher than the threshold value B, the given environment is determined to be a low-humidity environment.

When it has been determined that the given environment is a low-humidity environment in the step S327, the fixing temperature is raised by 10° C. from the ordinary temperature in the step S328. In the step S329, the front end of the recording material P enters into the fixing nipper section to finish the processing for printing in the step S317. Further, in the case of the fourth embodiment, the control range for raising fixing temperature is set uniformly up to 10° C., while the control range for lowering the fixing temperature is set uniformly up to 15° C., but such method may be replaced with the method in which the fixing temperature is either raised or lowered in proportion to the difference between threshold value and the transfer voltage V as in the case of the third embodiment.

With such a construction as discussed above, it becomes possible for the set temperature of the image fixing unit to be controlled depending on the characteristic of the given recording material, thereby providing an image forming apparatus being free of the sheet jamming or poor image quality.

In the foregoing, the fourth embodiment is described as being a variation of the third embodiment, it is obvious that the fixing temperature control method employed for the fourth embodiment is also applicable to the control methods employed in the first and the second embodiments. For instance, in applying the control method of the fourth embodiment to the first embodiment, if the detected transfer voltage V is higher than the predetermined threshold value, and the detected size of the recording material is smaller than the predetermined size (e.g., B5 size), the control effect similar to that obtainable by the fourth embodiment can be obtained by raising the fixing temperature.

(A Fifth Embodiment)

The fixing temperature controller 23 discussed in the case of the first, second, third and forth embodiment determines whether the recording material is or not a high hygroscopic property according to the transfer voltage V generated by the DC high voltage generator 18 when the toner image on the photosensitive drum 1 is transferred to the recording material P. In the case of the fifth embodiment, the fixing temperature controller 23 determines whether the recording material is or not a high hygroscopic property according to the transfer current I detected by the fixing current detector 31.

The transfer voltage controller 19 discussed in the case of the first, second, third and forth embodiment controls the transfer voltage V generated by the DC high voltage generator 18 so that the fixing current detector 31 detects a constant current. In the case of the fifth embodiment, the transfer voltage controller 19 causes the DC high voltage generator 18 to output the constant transfer voltage Vt.

Figure 14:
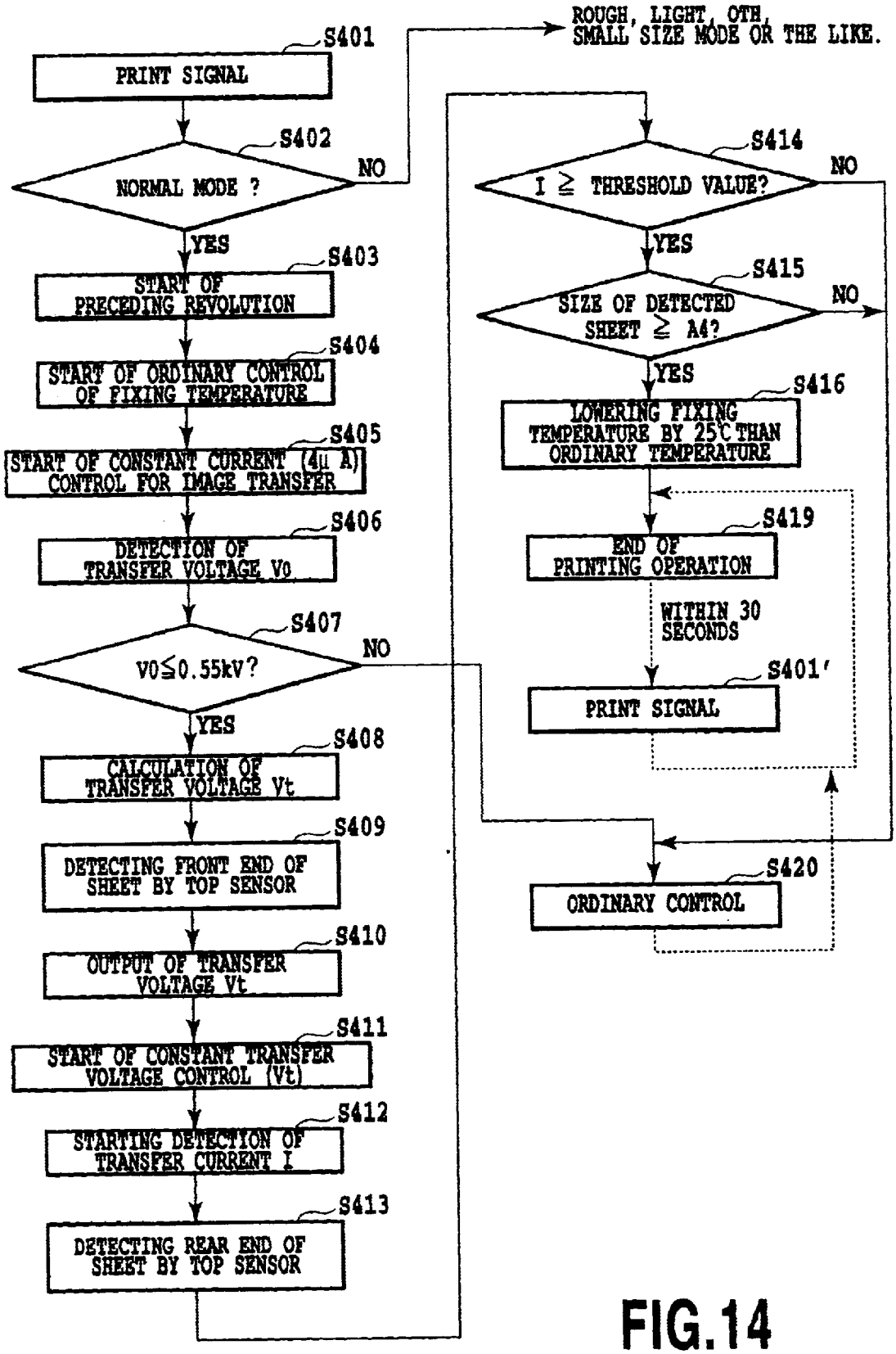
FIG. 14 is a flowchart illustrating the temperature setting control for the image fixing unit 11 incorporated into the laser beam printer according to the fifth embodiment of the present invention.

FIG. 14 shows the temperature setting process control for the image fixing unit 11 constituting the laser beam printer as the fifth embodiment of the present invention. The descriptions of those operations ranging from step S401 to step S410 are omitted since being similar to those ranging from the step S101 to the step S110.

In step S411, the transfer voltage controller 19 starts the operation that the DC high voltage generator 18 outputs the constant transfer voltage Vt. In step S412, the transfer voltage controller 19 stores the result of detecting the transfer current I by the fixing current detector 31 when the constant transfer voltage Vt is applied to the transfer roller 5.

I step S414, whose front end of the recording material has already been detected by the top sensor 9 in step S413, the transfer voltage controller 19 compares the transfer current I detected in step 412 with a predetermined threshold current. The predetermined threshold current is used to determine whether the recording material is or not a high hygroscopic property and is 1.2 $I_0$ as the transfer current $I_0$ (=4 $\mu$A) flowing though the transfer roller 5 in step 405. If the transfer current I detected in step 412 is larger than the predetermined threshold current 1.2 I0, the transfer voltage controller 19 determines that the recording material is a high hygroscopic property and the processing proceeds to step S415.

The descriptions of those operations ranging from step S415 to step S420 are omitted since being similar to those ranging from the step S115 to the step S120 in FIG. 6. By designing the processing as described above, it can be made possible to properly control the temperature setting of the image fixing unit.

(A Sixth Embodiment)

In the second embodiment, the width of the recording material can be detected by the plurality of width sensors 9' to determine whether the recording material is or not a high hygroscopic property according to the detected width of the recording material. In the case of the sixth embodiment, the transfer voltage controller 19 causes the DC high voltage generator 18 to output the constant transfer voltage Vt when the toner image on the photosensitive drum 1 is transferred to the recording material P. In addition, threshold value is $1.2I_0+I_0\times(200-\text{sheet width (mm)}/100)$.

The sixth embodiment provides an optimum image fixing process control suiting the ordinary sheets and the small-size sheets having the qualities satisfying the requirements of the load capacity in the high-temperature environment without causing poor image fixing result even for the small-size sheets such as the postcard and the envelope.

(A Seventh Embodiment)

Figure 15:
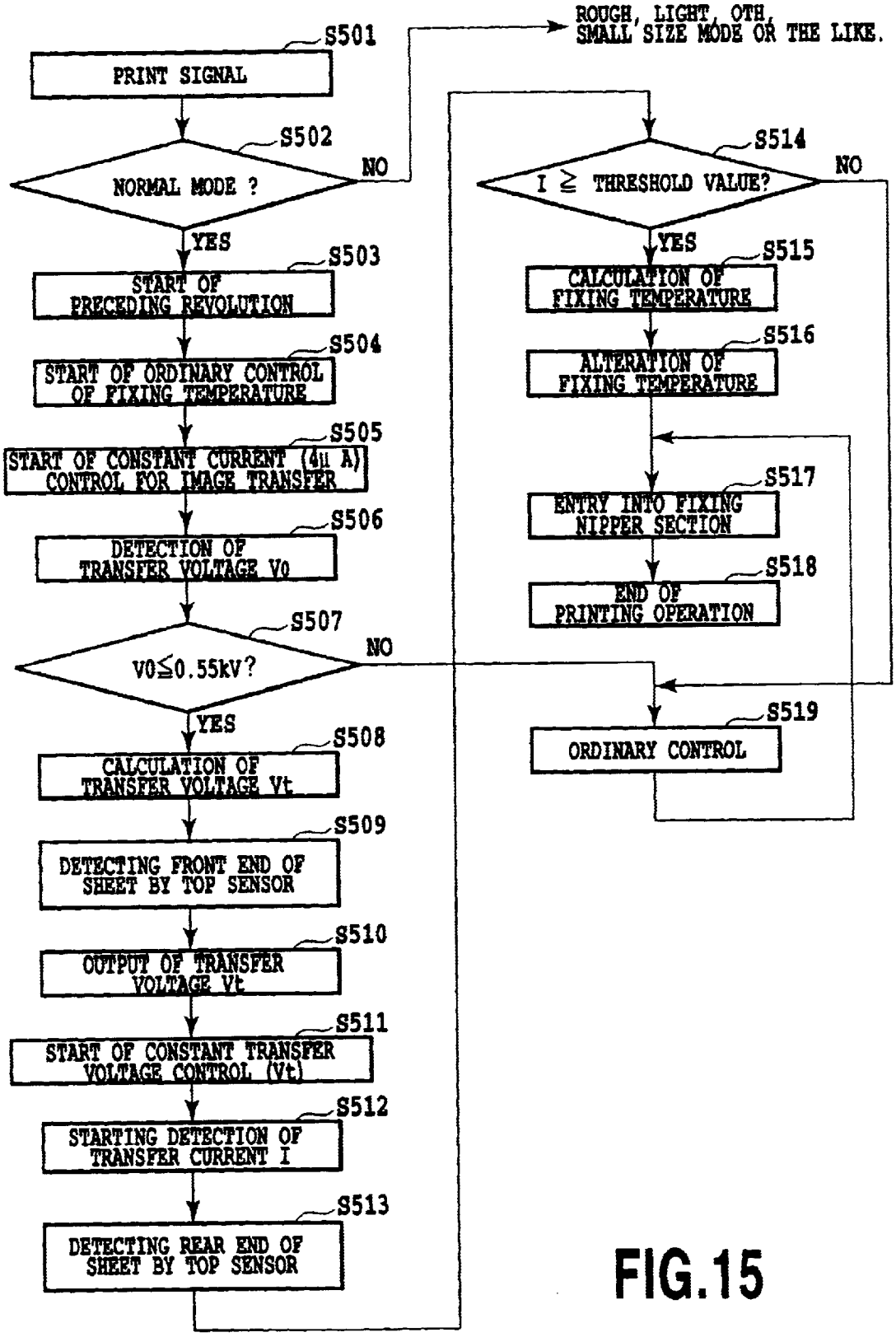
FIG. 15 is a flowchart illustrating the temperature setting control for the image fixing unit 11 incorporated into the laser beam printer according to the seventh embodiment of the present invention.

FIG. 15 shows the temperature setting process control for the image fixing unit 11 constituting the laser beam printer as the seventh embodiment of the present invention. The descriptions of those operations ranging from step S501 to step S510 are omitted since being similar to those ranging from the step S201 to the step S210.

In step S511, the transfer voltage controller 19 starts the operation that the DC high voltage generator 18 outputs the constant transfer voltage Vt. In step S512, the transfer voltage controller 19 stores the result of detecting the transfer current I by the fixing current detector 31 when the constant transfer voltage Vt is applied to the transfer roller 5.

In step S513, the equation given below is applicable, that is, $$\text{Threshold value}=1.2I_0+I_0\times(200-\text{sheet width (mm)})/100-0.2I_0\times\text{print rate (\%)}/100$$

is used to obtain the threshold value on which whether the fixing temperature needs to be altered or not is determined.

I step S514, the transfer voltage controller 19 compares the transfer current I detected in step 512 with a predetermined threshold current. If the transfer current I detected in step 512 is larger than the predetermined threshold current, the transfer voltage controller 19 determines that the recording material is a high hygroscopic property and the processing proceeds to step S515.

The descriptions of those operations ranging from step S515 to step S519 are omitted since being similar to those ranging from the step S215 to the step S219 in FIG. 12. By designing the processing as described above, it can be made possible to properly control the temperature setting of the image fixing unit depending on the print rate of the recording material, thereby enabling the imaging forming apparatus being free of the sheet jamming and poor image formation to be provided.

(A Eighth Embodiment)

Figures 16, 16A:
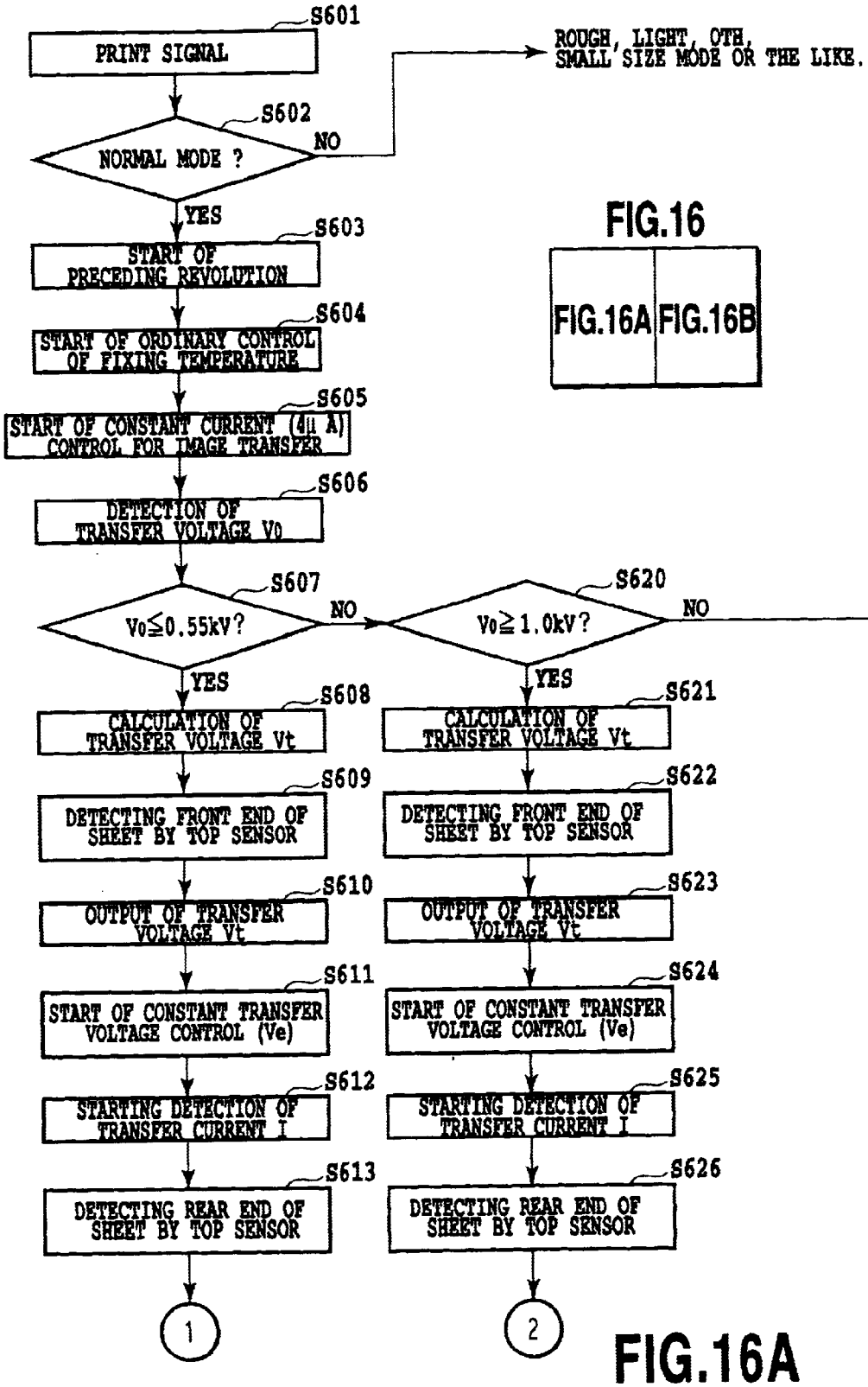
FIGS. 16A and 16B are flowcharts illustrating the temperature setting control for the image fixing unit 11 incorporated into the laser beam printer according to the eighth embodiment of the present invention.
Figure 16B:
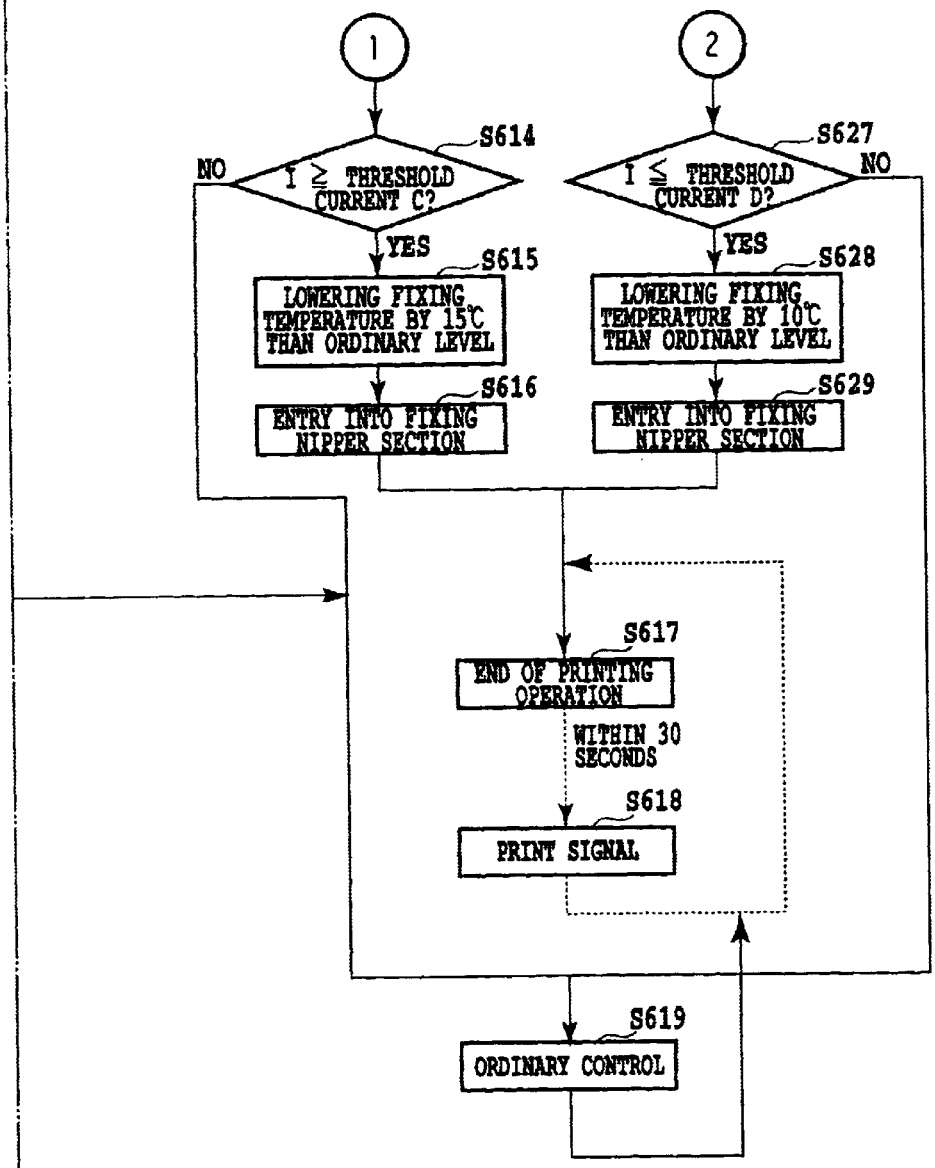

FIGS. 16A and 16B show the temperature setting process control for the image fixing unit 11 constituting the laser beam printer as the eighth embodiment of the present invention. The descriptions of those operations ranging from step S601 to step S610 are omitted since being similar to those ranging from the step S301 to the step S310.

In step S611, the transfer voltage controller 19 starts the operation that the DC high voltage generator 18 outputs the constant transfer voltage Vt. In step S612, the transfer voltage controller 19 stores the result of detecting the transfer current I by the fixing current detector 31 when the constant transfer voltage Vt is applied to the transfer roller 5.

I step S613, the equation given below is applicable, that is, $$\text{Threshold value}=1.2I_0+I_0\times(200-\text{sheet width (mm)})/100-0.210\times\text{print rate (\%)}/100$$

is used to obtain the threshold value C on which whether the fixing temperature needs to be altered or not is determined.

I step S614, the transfer voltage controller 19 compares the transfer current I detected in step 612 with the threshold value C. If the transfer current I detected in step 612 is larger than the threshold value C, the transfer voltage controller 19 determines that the recording material is a high hygroscopic property and the processing proceeds to step S515.

The descriptions of those operations ranging from step S615 to step S619 are omitted since being similar to those ranging from the step S315 to the step S319 in FIG. 13B. Also, the descriptions of those operations ranging from step S620 to step S623 are omitted since being similar to those ranging from the step S320 to the step S323.

In step S624, the transfer voltage controller 19 starts the operation that the DC high voltage generator 18 outputs the constant transfer voltage Vt. In step S625, the transfer voltage controller 19 stores the result of detecting the transfer current I by the fixing current detector 31 when the constant transfer voltage Vt is applied to the transfer roller 5.

I step S626, the threshold value D on which whether the fixing temperature needs to be altered or not is determined, is calculated. I step S627, the transfer voltage controller 19 compares the transfer current I detected in step 625 with the calculated threshold D. If the transfer current I detected in step 625 is smaller than the calculated threshold D, the transfer voltage controller 19 determines that the recording material is a high hygroscopic property and the processing proceeds to step S628.

The operations taking place in the step S629 is similar to those taking place in the step S329. By designing the processing as described above, it can be made possible to properly control the temperature setting of the image fixing unit depending on the print rate of the recording material, thereby enabling the imaging forming apparatus being free of the sheet jamming and poor image formation to be provided.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An image forming apparatus, comprising:

a transfer section for transferring a toner image formed on an image carrier onto a recording material;

a transfer voltage applying section for applying a voltage to said transfer section;

a transfer current detector for detecting the transfer current flowing through said transfer section;

a fixing section for fixing said toner image transferred onto said recording material by said transfer section to fixing position at a predetermined temperature; and a size detector for detecting the size of said recording material;

wherein said transfer voltage applying section applies a predetermined transfer voltage, while said recording material passes through said transfer section, so that said transfer current detected by said transfer current detector is kept a predetermined constant current;

when said predetermined transfer voltage is lower than a threshold voltage and the size of said recording material is larger than a predetermined size, said fixing section fixes said toner image at a temperature which is lower than said predetermined temperature.

2. The image forming apparatus as claimed in claim 1, wherein said transfer voltage applying section applies said predetermined transfer voltage to said transfer section before the front end of said recording material has passed said fixing position.

3. The image forming apparatus as claimed in claim 1, wherein said transfer voltage applying section applies a constant transfer voltage to said transfer section after said recording material has passed said transfer section until a lapse of a predetermined time.

4. The image forming apparatus as claimed in claim 1, wherein said transfer voltage applying section applies a first transfer voltage before said recording material passes through said transfer section so that said transfer current detected by said transfer current detector is kept a first constant current, said transfer voltage applying section applies a second transfer voltage, while said recording material passes through said transfer section, so that said transfer current detected by said transfer current detector is kept a second constant current, when said first transfer voltage is lower than a first threshold voltage, said second transfer voltage is lower than a second threshold voltage and the size of said recording material is larger than the predetermined size, said fixing section fixes said toner image at a temperature which is lower than said predetermined temperature.

5. The image forming apparatus as claimed in claim 1 further comprising:

a memory for storing a temperature which said fixing section fixes said toner image upon completion of the image formation; and a lapse of time detector for detecting a lapse of time from the completion of the image formation;

wherein, if said lapse time detected by said lapse of time detector is lower than a predetermined time upon starting the image formation, said fixing section fixes said toner image at a temperature which is stored in said memory.

6. The image forming apparatus as claimed in claim 1, wherein, when said predetermined transfer voltage is lower than a threshold voltage and the size of said recording material is larger than the predetermined size, said fixing section fixes said toner image for a recording material conveyed following said recording material which the size is detected by said size detector at a temperature which is lower than said predetermined temperature.

7. The image forming apparatus as claimed in claim 1, wherein said size detector detects the size of said recording material by detecting the front end and the rear end of said recording material.

8. The image forming apparatus as claimed in claim 1, wherein said size detector detects the width of the recording material orthogonal to the direction of the transfer thereof.

9. An image forming apparatus, comprising:

a transfer section for transferring a toner image formed on an image carrier onto a recording material;

a transfer voltage applying section for applying a voltage to said transfer section;

a transfer current detector for detecting the transfer current flowing through said transfer section;

a fixing section for fixing said toner image transferred onto said recording material by said transfer section to fixing position at a predetermined temperature; and a signal receiver for receiving an image data transmitted to said image forming apparatus from an external apparatus;

wherein said transfer voltage applying section applies a predetermined transfer voltage, while said recording material passes through said transfer section, so that said transfer current detected by said transfer current detector is kept a predetermined constant current;

when said predetermined transfer voltage is lower than a threshold voltage based on said size of said recording material and a print rate of said image data received by said signal receiver, said fixing section fixes said toner image at a temperature which is lower than said predetermined temperature.

10. The image forming apparatus as claimed in claim 9, wherein said transfer voltage applying section applies said predetermined transfer voltage to said transfer section before the front end of said recording material has passed said fixing position.

11. The image forming apparatus as claimed in claim 9, wherein said transfer voltage applying section applies a constant transfer voltage to said transfer section after said recording material has passed said transfer section until a lapse of a predetermined time.

12. The image forming apparatus as claimed in claim 9, wherein said transfer voltage applying section applies a first transfer voltage before said recording material passes through said transfer section so that said transfer current detected by said transfer current detector is kept a first constant current, said transfer voltage applying section applies a second transfer voltage, while said recording material passes through said transfer section, so that said transfer current detected by said transfer current detector is kept a second constant current, when said first transfer voltage is lower than a first threshold voltage and said second transfer voltage is lower than a second threshold voltage based on said size and said print rate, said fixing section fixes said toner image at a temperature which is lower than said predetermined temperature.

13. The image forming apparatus as claimed in claim 9 further comprising:

a memory for storing a temperature which said fixing section fixes said toner image upon completion of the image formation; and a lapse of time detector for detecting a lapse of time from the completion of the image formation;

wherein, if said lapse time detected by said lapse of time detector is lower than a predetermined time upon starting the image formation, said fixing section fixes said toner image at a temperature which is stored in said memory.

14. The image forming apparatus as claimed in claim 9, wherein, when said predetermined transfer voltage is lower than a threshold voltage based on said size of said recording material and a print rate of said image data received by said signal receiver, said fixing section fixes said toner image for a recording material conveyed following said recording material which the size is detected by said size detector at a temperature which is lower than said predetermined temperature.

15. An image forming apparatus, comprising:

a transfer section for transferring a toner image formed on an image carrier onto a recording material;

a transfer voltage applying section for applying a voltage to said transfer section;

a transfer current detector for detecting a transfer current flowing through said transfer section;

a fixing section for fixing said toner image transferred onto said recording material by said transfer section to fixing position at a predetermined temperature; and a signal receiver for receiving an image data transmitted to the image forming apparatus from an external apparatus;

wherein said transfer voltage applying section applies a predetermined transfer voltage, while said recording material passes through said transfer section, so that said transfer current detected by said transfer current detector is kept a predetermined constant current;

when said predetermined transfer voltage is larger than a threshold voltage based on said size of said recording material and a print rate of said image data received by said signal receiver, said fixing section fixes said toner image at a temperature which is larger than said predetermined temperature.

16. The image forming apparatus as claimed in claim 15, wherein said transfer voltage applying section applies said predetermined transfer voltage to said transfer section before the front end of said recording material has passed said fixing position.

17. The image forming apparatus as claimed in claim 15, wherein said transfer voltage applying section applies a constant transfer voltage to said transfer section after said recording material has passed said transfer section until a lapse of a predetermined time.

18. The image forming apparatus as claimed in claim 15, wherein said transfer voltage applying section applies a first transfer voltage before said recording material passes through said transfer section so that said transfer current detected by said transfer current detector is kept a first constant current, said transfer voltage applying section applies a second transfer voltage, while said recording material passes through said transfer section, so that said transfer current detected by said transfer current detector is kept a second constant current, when said first transfer voltage is larger than a first threshold voltage and said second transfer voltage is larger than a second threshold voltage based on said size and said print rate, said fixing section fixes said toner image at a temperature which is larger than said predetermined temperature.

19. The image forming apparatus as claimed in claim 15 further comprising:

a memory for storing a temperature which said fixing section fixes said toner image upon completion of the image formation; and a lapse of time detector for detecting a lapse of time from the completion of the image formation;

wherein, if said lapse time detected by said lapse of time detector is lower than a predetermined time upon starting the image formation, said fixing section fixes said toner image at a temperature which is stored in said memory.

20. The image forming apparatus as claimed in claim 15, wherein, when said predetermined transfer voltage is larger than a threshold voltage based on said size of said recording material and a print rate of said image data received by said signal receiver, said fixing section fixes said toner image for a recording material conveyed following said recording material which the size is detected by said size detector at a temperature which is larger than said predetermined temperature.

21. An image forming apparatus, comprising:

a transfer section for transferring a toner image formed on an image carrier onto a recording material;

a transfer voltage applying section for applying a voltage to said transfer section;

a transfer current detector for detecting a transfer current flowing through said transfer section;

a fixing section for fixing said toner image transferred onto said recording material by said transfer section to fixing position at a predetermined temperature; and a size detector for detecting the size of said recording material;

wherein said transfer current detector detects a transfer current when said transfer voltage applying section applies a predetermined transfer voltage, while said recording material passes through said transfer section;

when said transfer current is larger than a threshold current and the size of said recording material is larger than a predetermined size, said fixing section fixes said toner image at a temperature which is lower than said predetermined temperature.

22. An image forming apparatus, comprising:

a transfer section for transferring a toner image formed on an image carrier onto a recording material;

a transfer voltage applying section for applying a voltage to said transfer section;

a transfer current detector for detecting a transfer current flowing through said transfer section;

a fixing section for fixing said toner image transferred onto said recording material by said transfer section to fixing position at a predetermined temperature; and a signal receiver for receiving an image data transmitted to said image forming apparatus from an external apparatus;

wherein said transfer current detector detects a transfer current when said transfer voltage applying section applies a predetermined transfer voltage, while said recording material passes through said transfer section;

when said transfer current is larger than a threshold current based on said size of said recording material and a print rate of said image data received by said signal receiver, said fixing section fixes said toner image at a temperature which is lower than said predetermined temperature.

23. An image forming apparatus, comprising:

a transfer section for transferring a toner image formed on an image carrier onto a recording material;

a transfer voltage applying section for applying a voltage to said transfer section;

a transfer current detector for detecting a transfer current flowing through said transfer section;

a fixing section for fixing said toner image transferred onto said recording material by said transfer section to fixing position at a predetermined temperature; and a signal receiver for receiving an image data transmitted to said image forming apparatus from an external apparatus;

wherein said transfer current detector detects a transfer current when said transfer voltage applying section applies a predetermined transfer voltage, while said recording material passes through said transfer section;

when said transfer current is lower than a threshold current based on said size of said recording material and a print rate of said image data received by said signal receiver, said fixing section fixes said toner image at a temperature which is larger than said predetermined temperature.

24. An image forming apparatus, comprising:

a transfer section for transferring a toner image formed on an image carrier onto a recording material;

a transfer voltage applying section for applying a voltage to said transfer section;

a transfer current detector for detecting a transfer current flowing through said transfer section;

a fixing section for fixing said toner image transferred onto said recording material by said transfer section to fixing position at a predetermined temperature;

a size detector for detecting the size of said recording material; and a controller for controlling said transfer voltage applying section to apply a predetermined transfer voltage based on said transfer current detected by said transfer current detector, while said recording material passes through said transfer section;

wherein said controller controls said fixing section to fix said toner image to said recording material at a temperature which is lower than said predetermined temperature based on said predetermined transfer voltage and the size of said recording material detected by said size detector.

25. The image forming apparatus as claimed in claim 24, wherein said transfer voltage applying section applies a first transfer voltage based on said transfer current detected by said transfer current detector before said recording material has passed said transfer section;

said transfer voltage applying section applies a second transfer voltage based on said transfer current detected by said transfer current detector, while said recording material passes through said transfer section; and said controller controls said fixing section to fix said toner image to said recording material at a temperature which is lower than said predetermined temperature based on said first transfer voltage, said second transfer voltage and the size of said recording material detected by said size detector.

* * * * *

UNITED STATES PATENT AND TRADEMARK OFFICE

CERTIFICATE OF CORRECTION

PATENT NO. : 6,947,679 B2
DATED : September 20, 2005
INVENTOR(S) : Akira Kato et al.

It is certified that error appears in the above-identified patent and that said Letters Patent is hereby corrected as shown below:

Title page,
Item [56], References Cited, FOREIGN PATENT DOCUMENTS, "2003005576 A" should read -- 2003-005576 A --.

Column 2,
Line 40, "properties," should read -- property, --.

Column 4,
Line 63, "with" should read -- to --.

Column 6,
Line 3, "contained" should read -- be contained --.

Column 7,
Line 52, "revolve" should read -- revolves --.

Column 11,
Line 35, "he" should read -- the --.

Column 12,
Line 26, "I" should read -- In --.
Line 57, "by that" should read -- because --.

Column 13,
Line 18, "o" should read -- to --.

Column 14,
Line 3, "applied" should read -- be applied --.
Line 29, "the" should read -- than the --.
Line 37, "the" (1st occurrence) should read -- than the --.

Column 15,
Line 1, "pint" should read -- print --.

Column 21,
Line 21, "I" should read -- In --.

Column 22,
Lines 10, 40, 47 and 66, "I" should read -- In --.
Line 26, "(A" should read -- (An --.

UNITED STATES PATENT AND TRADEMARK OFFICE

CERTIFICATE OF CORRECTION

PATENT NO. : 6,947,679 B2
DATED : September 20, 2005
INVENTOR(S) : Akira Kato et al.

It is certified that error appears in the above-identified patent and that said Letters Patent is hereby corrected as shown below:

Column 23,
Line 1, "I" should read -- In --.

Column 24,
Line 56, "said" (1st occurrence) should read -- a --.

Column 25,
Line 63, "said" (1st occurrence) should read -- a --.

Column 27,
Lines 23 and 47, "said" should read -- a --.

Signed and Sealed this

Fourteenth Day of March, 2006

JON W. DUDAS
*Director of the United States Patent and Trademark Office*